US010613474B2

(12) United States Patent
Yasui

(10) Patent No.: US 10,613,474 B2
(45) Date of Patent: Apr. 7, 2020

(54) IMAGE FORMING APPARATUS

(71) Applicant: CANON KABUSHIKI KAISHA, Tokyo (JP)

(72) Inventor: Tatsuo Yasui, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 15/880,727

(22) Filed: Jan. 26, 2018

(65) Prior Publication Data

US 2018/0217553 A1 Aug. 2, 2018

(30) Foreign Application Priority Data

Jan. 30, 2017 (JP) ..... 2017-014079
Dec. 5, 2017 (JP) ..... 2017-233339

(51) Int. Cl.
*G03G 15/00* (2006.01)
*G03G 21/16* (2006.01)

(52) U.S. Cl.
CPC ..... *G03G 21/1695* (2013.01); *G03G 15/657* (2013.01)

(58) Field of Classification Search
CPC ..... G03G 15/00; G03G 15/20; G03G 15/657; G03G 21/00; G03G 21/16; G03G 21/1695
See application file for complete search history.

(56) References Cited

U.S. PATENT DOCUMENTS 7,391,993 B2 * 6/2008 Ito ..... G03G 21/1638 399/124
8,331,826 B2 * 12/2012 Minanninaka ..... G03G 21/1633 399/110
9,471,034 B2 * 10/2016 Yokoi ..... G03G 21/1803
2008/0317532 A1 * 12/2008 Ehara ..... G03G 15/657 399/400
2011/0044704 A1 * 2/2011 Uehara ..... G03G 15/6529 399/21
2014/0233991 A1 * 8/2014 Moon ..... G03G 15/2028 399/322
2014/0270846 A1 * 9/2014 Embry ..... G03G 21/1633 399/114
2016/0124382 A1 * 5/2016 Uehara ..... G03G 21/1685 399/122
2018/0032026 A1 * 2/2018 Keniston ..... G03G 21/1633

FOREIGN PATENT DOCUMENTS

JP H04-044075 A 2/1992
JP H04-044076 A 2/1992
JP H04-044077 A 2/1992
(Continued)

*Primary Examiner* — Nguyen Q. Ha
(74) *Attorney, Agent, or Firm* — Venable LLP

(57) ABSTRACT

An image forming apparatus includes a main assembly; a transfer portion; a fixing portion; an opening provided on the main assembly; a door; a first guiding member provided in the main assembly and a second guiding member provided on the door and is interlaced with the first guiding member; a supporting plate supporting the first guiding member; the first guiding member has a convex curved surface of a shape such that a force received by the first guiding member when the door is opened with a sheet jammed between the first and second guiding members is in a direction of urging the first guiding member to the supporting plate.

20 Claims, 10 Drawing Sheets

(56) References Cited

FOREIGN PATENT DOCUMENTS

| | | | |
|---|---|---|---|
| JP | H04-044078 | A | 2/1992 |
| JP | H04-044079 | A | 2/1992 |
| JP | H04-044080 | A | 2/1992 |
| JP | H04-044081 | A | 2/1992 |
| JP | H04-044082 | A | 2/1992 |
| JP | H04-044083 | A | 2/1992 |
| JP | H04-204980 | A | 7/1992 |
| JP | H04-204981 | A | 7/1992 |
| JP | H04-204982 | A | 7/1992 |
| JP | H04-204983 | A | 7/1992 |
| JP | H04-204984 | A | 7/1992 |
| JP | 2013-234011 | A | 11/2013 |

* cited by examiner

IMAGE FORMING APPARATUS

FIELD OF THE INVENTION AND RELATED ART

The present invention relates to an electrophotographic image forming apparatus for forming an image on a sheet of recording medium. More concretely, it relates to an electrophotographic copying machine, an electrophotographic printing machine, an electrophotographic facsimileing machine, and a multifunction image forming apparatus capable of functioning as any of the preceding examples of electrophotographic image forming apparatus.

In an image forming apparatus such as those mentioned above, a sheet of recording medium (which hereafter may be referred to as sheet of recording paper, or simply as sheet of paper) is sent to the transferring apparatus of the image forming apparatus from the sheet feeding-conveying portion of the apparatus. Then, a toner image is transferred onto the sheet of recording paper by the transferring apparatus. Thereafter, the sheet is conveyed to the fixing apparatus, in which the toner image is fixed to the sheet. The image forming apparatus is provided with a multiple recording medium conveyance guides, which are disposed between the transferring portion and fixing portion of the image forming apparatus, in a manner to provide a recording medium conveyance passage through which the sheet of recording paper is guided to the fixation nip of the fixing apparatus after being conveyed through the transferring portion.

It has been known that some image forming apparatus are structured so that if a sheet of recording paper becomes stuck (which hereafter may be referred to as "paper jam") in the recording medium passage between the transferring portion and fixing portion, a part (or parts) of the multiple (two, for example) recording medium guiding members is moved to open up the portion of the recording paper passage, which normally remains covered with the part (parts) of the recording sheet guiding member, in order to allow the jammed sheet of recording paper to be moved out of the recording paper passage (Japanese Laid-open Patent Application No. 2013-234011).

In a case of an image forming apparatus, such as the above-described one, a part of the recording paper passage is made of a combination of a stationary recording sheet guiding member and a movable recording sheet guiding member. Further, the portion of the stationary recording sheet guiding member, which faces the movable recording sheet guiding member, is provided with a preset number of protrusions which look like the teeth of a comb and are separated from the adjacent protrusions by various distances, whereas the portion of the movable recording sheet guiding member, which faces the stationary recording sheet guiding member, is also provided with a preset number of protrusions which look like the teeth of a comb and are separated from the adjacent protrusions by various distances. Moreover, the image forming apparatus is structured so that as the door by which the movable recording sheet guiding member is supported is closed, the portion of the movable recording paper guiding member, which has the tooth-like protrusions, overlaps (meshes) with the portion of the stationary recording paper guiding member, which has the tooth-like protrusions, in order to ensure that the a sheet P of recording paper is smoothly guided onto the stationary recording paper guiding member from the movable recording paper guiding member.

SUMMARY OF THE INVENTION

In a case of an image forming apparatus structured so that a pair of recording sheet guiding member, which the apparatus is provided, are shaped so that they overlap (mesh) with each other, it sometimes occurs that while one of the recording sheet guiding member is in a preset position into which it is to be moved to open up the recording paper passage in order to enable a user to remove a jammed sheet of recording paper in the recording paper passage, a sheet of recording paper enters the area in which the pair of recording sheet guiding members overlap (mesh) with each other due to the operational errors or the like committed by the user. If an attempt is made by the user to move the movable recording sheet guiding member into the position in which it is to remain overlapped (meshed) with the stationary recording sheet guiding member, while a sheet of recording paper is in the area in which the pair of recording sheet guiding member remain overlapping (in mesh) with each other, the two recording sheet guiding member are not allowed to overlap (mesh) with each other, causing sometimes the recording sheet guiding member(s) to be deformed or damaged by the force to which they are subjected through the sheet of recording paper.

The present invention was made in consideration of the above-described issue. Thus, the primary object of the present invention is to provide an image forming apparatus which can prevent the problem that one or both of the pair of its recording sheet guiding members, are damaged by the force to which the recording sheet guiding members are subjected through a sheet of recording paper as the sheet accidentally remains in the area in which the pair of recording sheet guiding members overlap (mesh) with each other, because of the operational error or the like committed by a user.

According to an aspect of the present invention, there is provided an image forming apparatus comprising a main assembly; a transfer portion provided in said main assembly and configured to transfer a toner image onto a transfer nip; a fixing portion provided in said main assembly and configured to fix, at a fixing nip, the toner image transferred by said transfer portion; an opening provided on said main assembly; an openable member movable between a closing position for closing said opening and an open position for opening said opening; a first guiding member and a second guiding member cooperative with each other to provide a feeding surface for a recording material from the transfer nip toward said fixing nip, in a state that said openable member is in the closing position; wherein when said openable member is in the open position, said first guiding member is in said main assembly, wherein said second guiding member movable together with said openable member in interrelation with opening and closing operation of said openable member, wherein said first guiding member and said second guiding member form the feeding surface by a projection said second guiding member being placed in the recess of said first guiding member with a closing operation of said openable member moving from the open positions to the closing position, wherein when said openable member is in the closing position, the first guiding member is downstream of a second guiding member with respect to the feeding direction of the recording material, wherein when said openable member is in the closing position, said recess of said first guiding member is recessed toward a downstream side with respect to the feeding direction, and said projection of said second guiding member is projected toward the downstream side with respect to the feeding direction; and a metal plate extending in a lateral direction perpendicular to said feeding surface and having a supporting surface supporting said first guiding member across the lateral direction, wherein said first guiding member is fixed to said supporting surface, wherein as seen in the lateral direction, said first guiding member has a convex curved surface portion at the position where said first guiding member first overlaps with said projection of said second guiding member in the closing operation of said openable member, and wherein when a point Q is a point on said projection which starts to overlap with the curved surface portion, in the closing operation of said openable member, as said projection of said second guiding member, said first guiding member at the position having the curved surface portion in the lateral direction and said metal plate are seen in the lateral direction, said curved surface portion is formed such that a normal line L to an imaginary tangent line of the curved surface portion and passing through the point Q crosses with said supporting surface of said metal plate.

Further features of the present invention will become apparent from the following description of exemplary embodiments with reference to the attached drawings.

Figure 4:
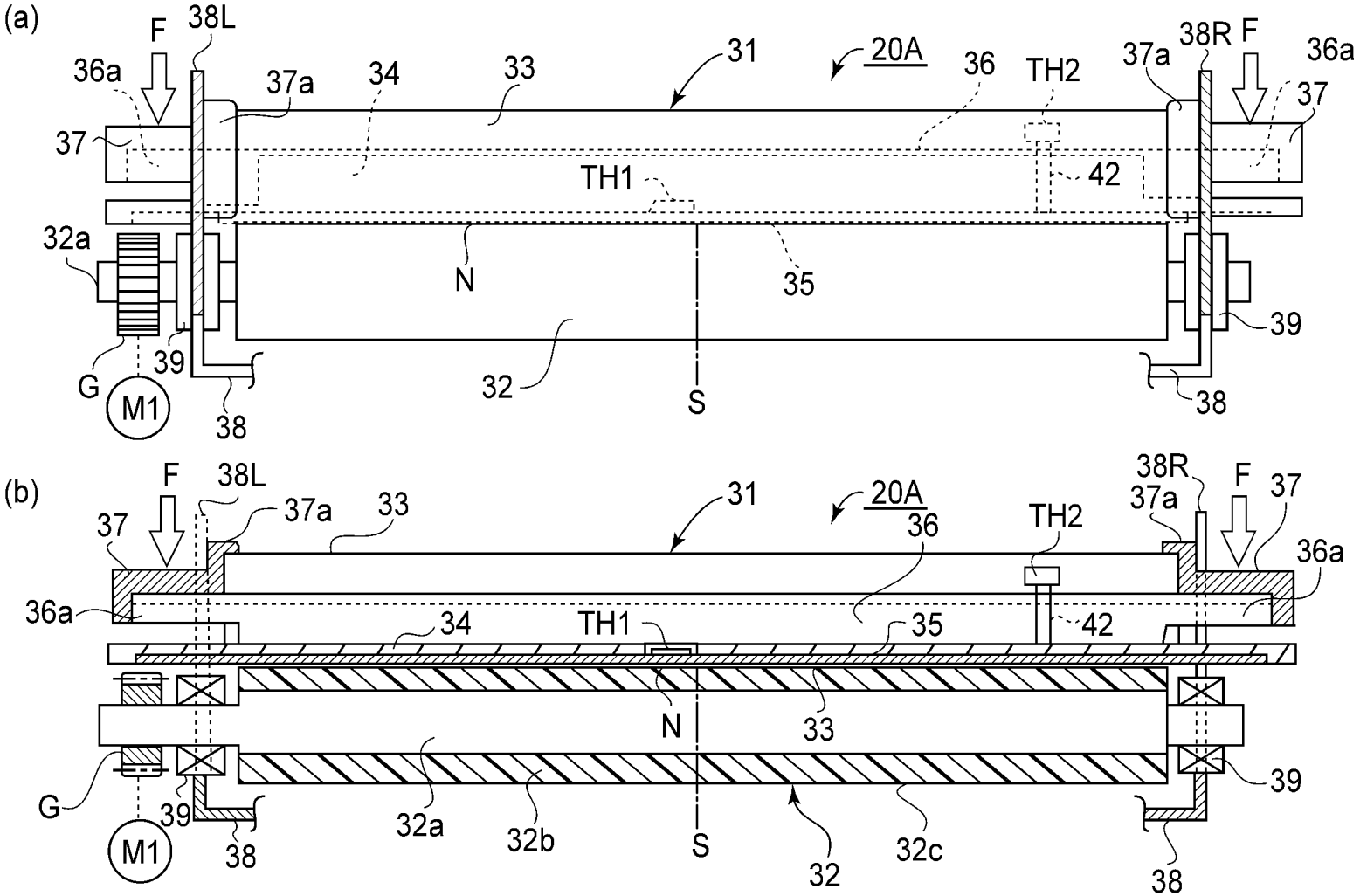

Part (a) of FIG. 4 is a schematic front view of a combination of the fixing belt assembly, pressure roller, and their adjacencies, of the fixing apparatus of the image forming apparatus in the first embodiment, and part (b) of FIG. 4 is a schematic sectional view of the combination shown in part (a) of FIG. 4, at a vertical plane perpendicular to the recording sheet conveyance direction, a seen from the front side of the apparatus.

Figure 5:
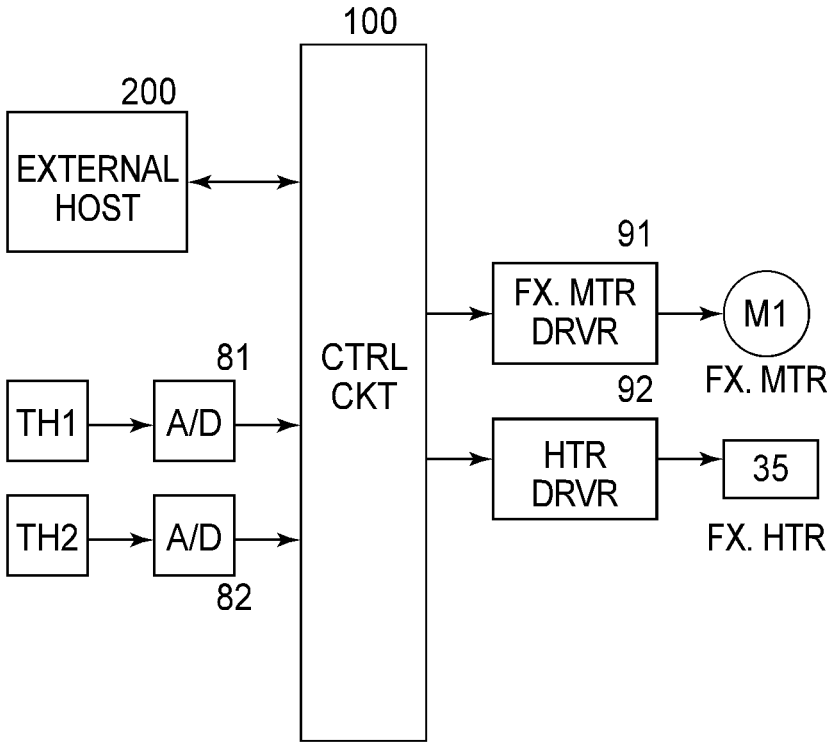

FIG. 5 is a block diagram of the portion of the control system of the image forming apparatus, which is for controlling the fixing apparatus.

Figure 6A:
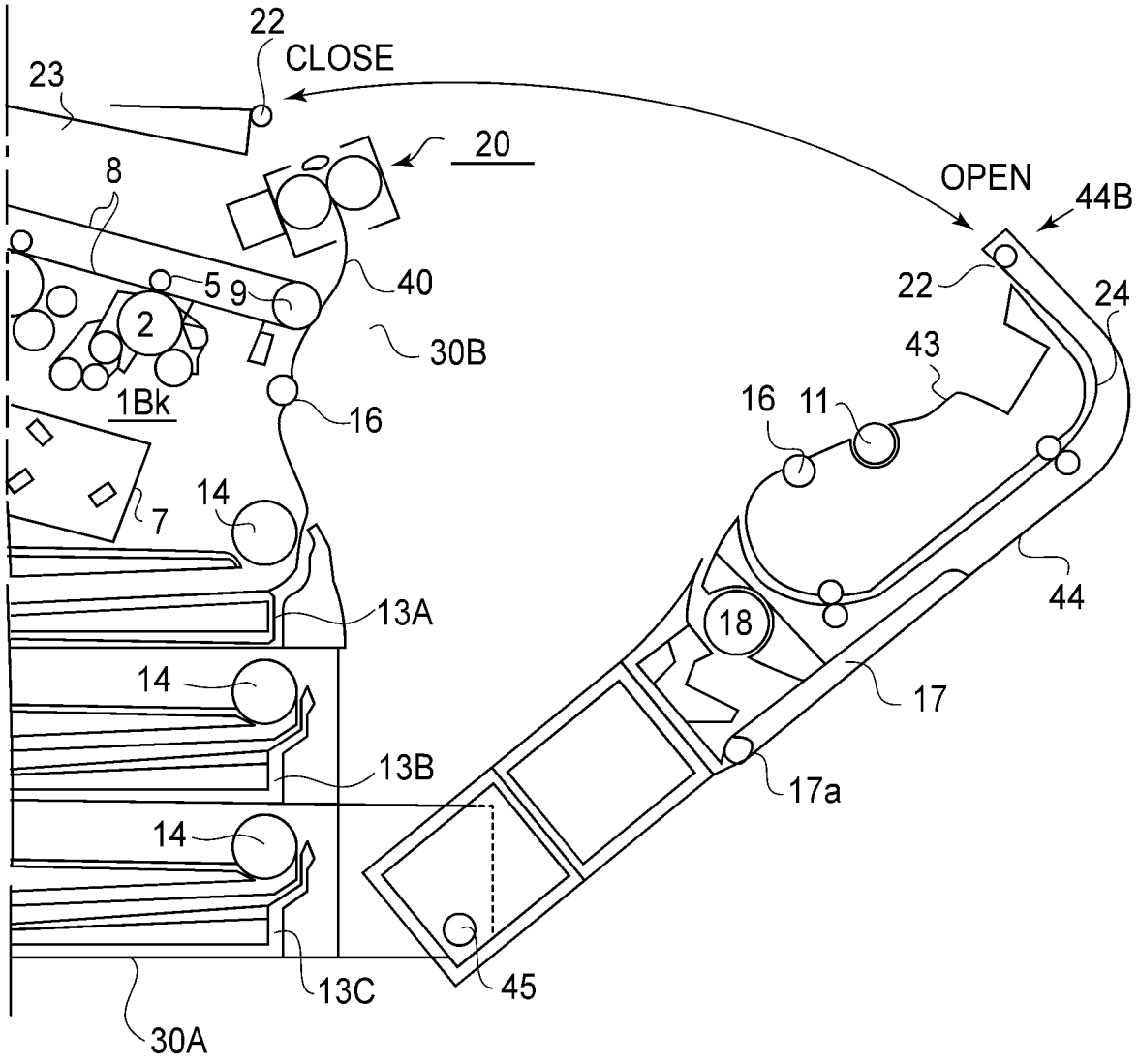

FIG. 6A is a schematic sectional view of the front portion of the image forming apparatus in the first embodiment, at a vertical plane parallel to the recording sheet conveyance direction, when the front door of the apparatus is open.

Figure 6B:
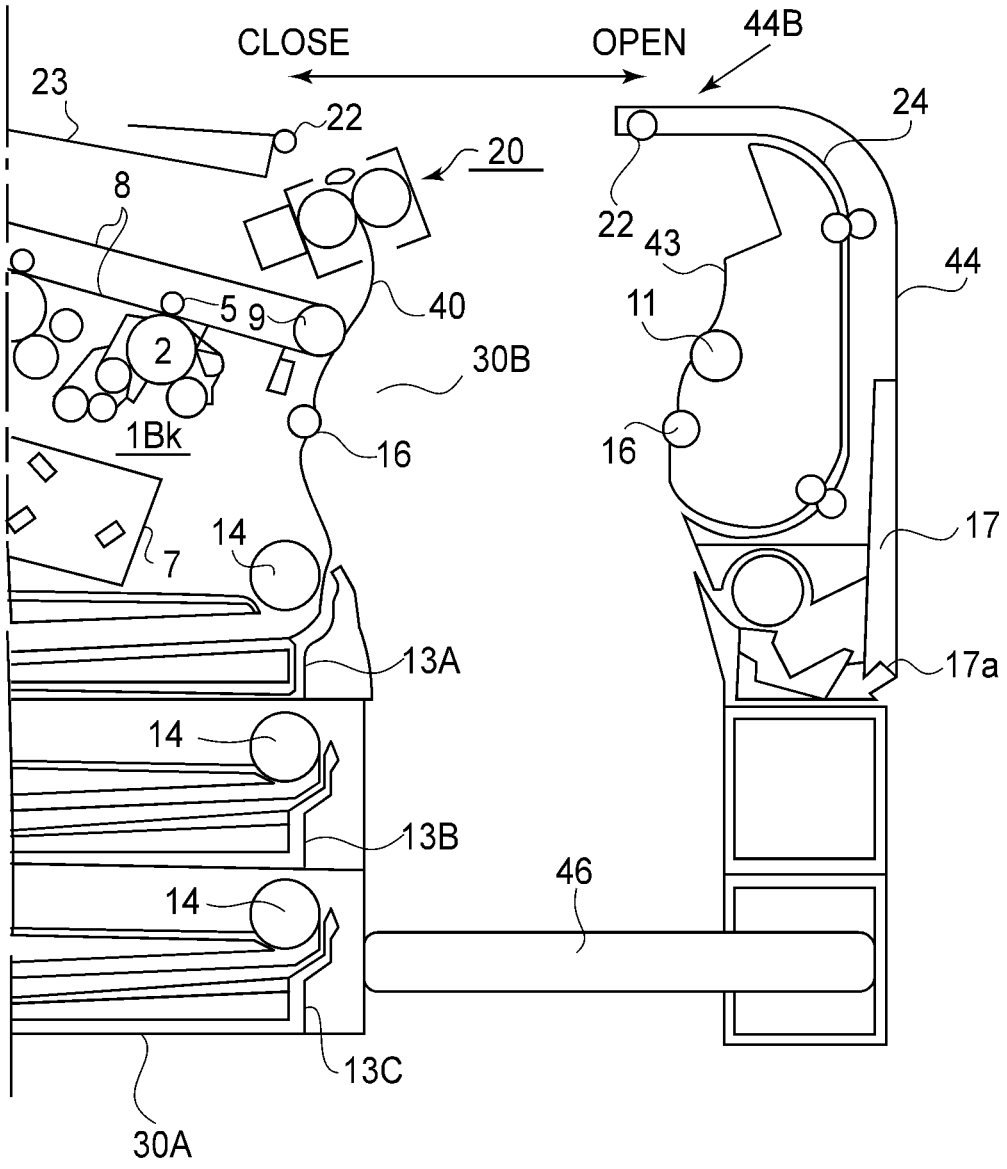

FIG. 6B is a schematic sectional view of the front portion of the image forming apparatus which is different in structure from the one shown in FIG. 6A, at a vertical plane parallel to the recording sheet conveyance direction, when the front door of the apparatus is open.

Figure 7:
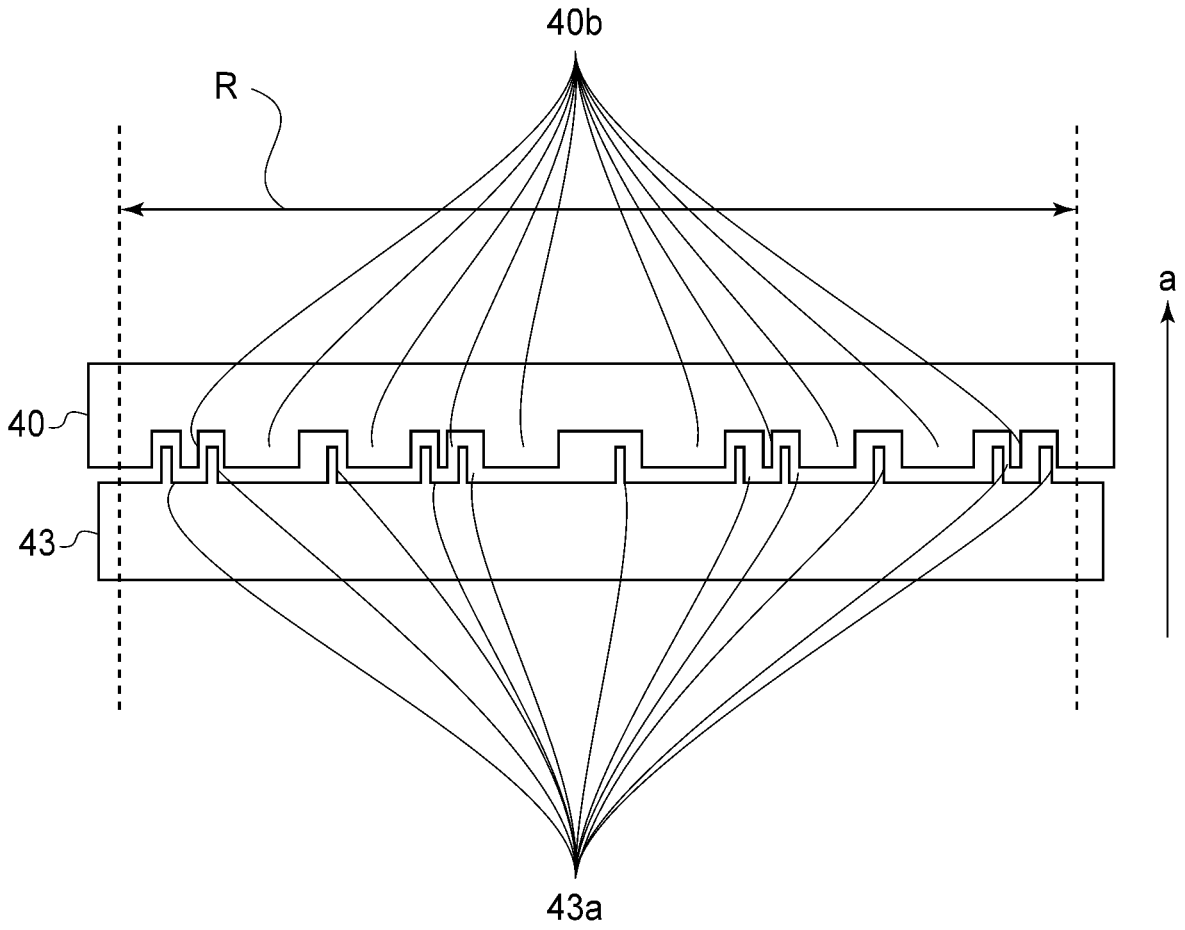

FIG. 7 is a schematic front view of a combination of the entrance guide and post-transfer guide.

Figure 8:
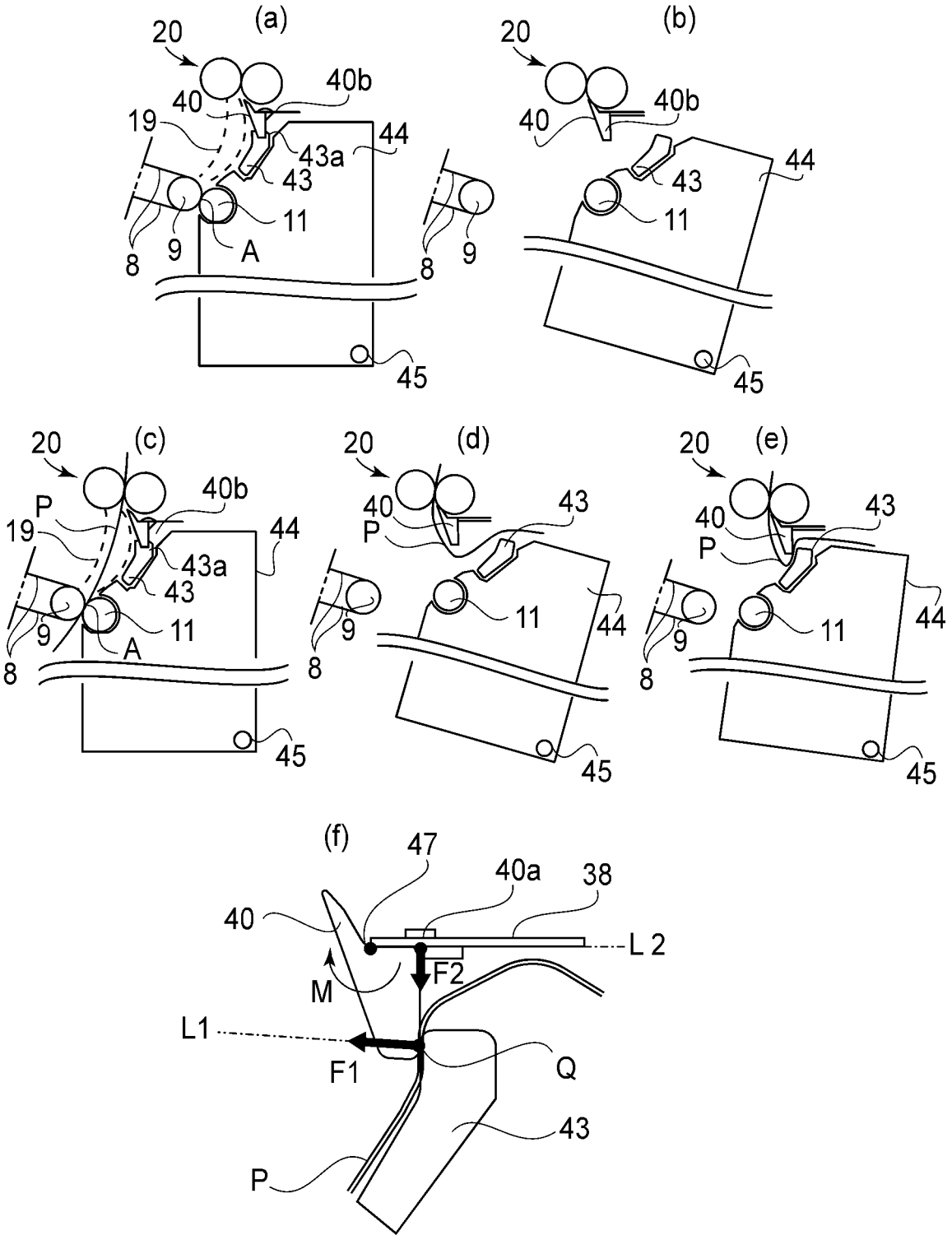

FIG. 8 is a collection of the vertical sectional views of the recording paper passage between the transferring portion and fixing apparatus of the image forming apparatus, and its adjacencies, which is for describing the change in the positional relationship between the fixing apparatus entrance guide and post-transfer guide, which occurs when the door of the image forming apparatus is pivotally moved (opened and closed) to remove a jammed sheet of recording paper, and also, for describing how the changes in the positional relationship between the entrance guide and post-transfer guide causes a sheet of recording paper to interfere with the closing of the door.

Figure 9:
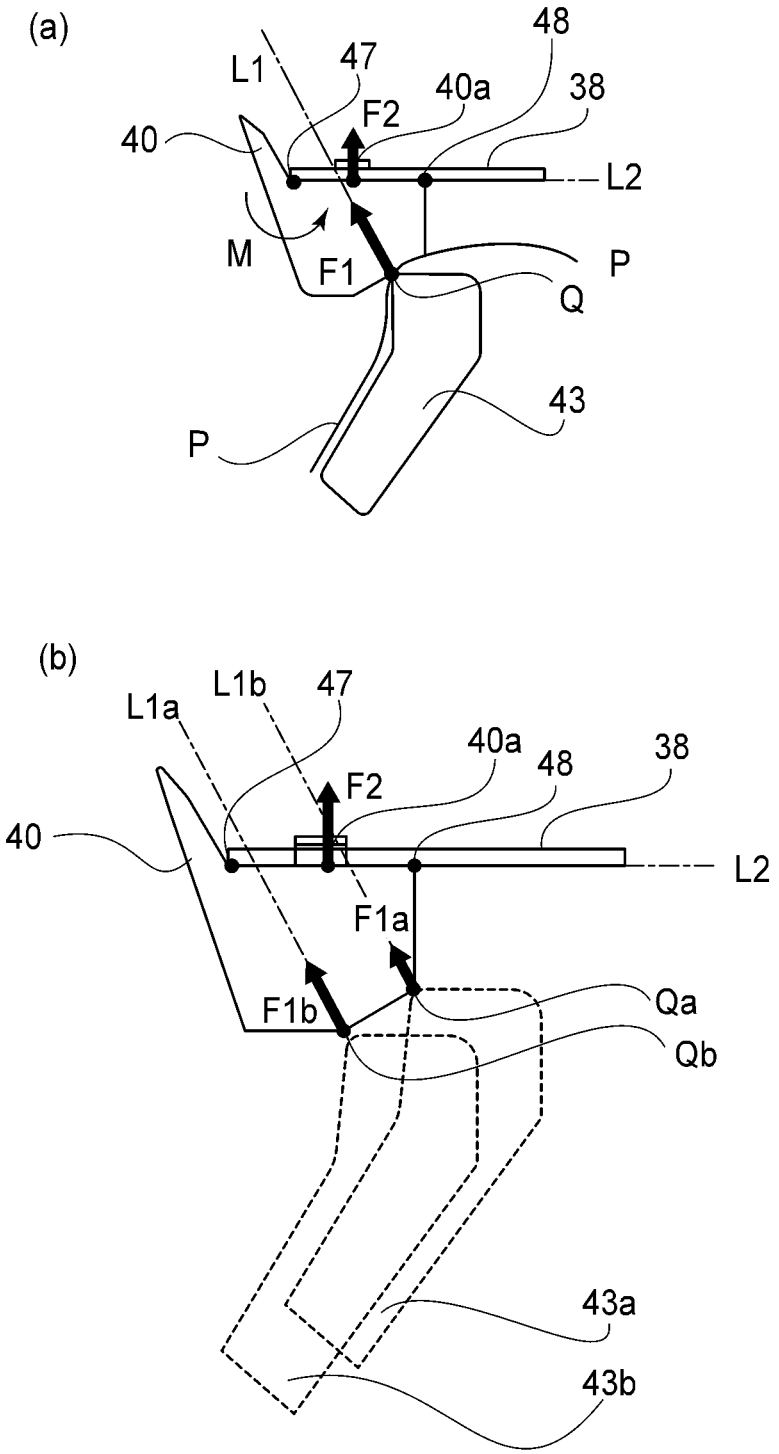

FIG. 9 is a schematic sectional view of the portion of the image forming apparatus in the second embodiment of the present invention, to which the present invention is related.

DESCRIPTION OF THE EMBODIMENTS

Embodiment 1

(1) Image Forming Portion

Figure 2:
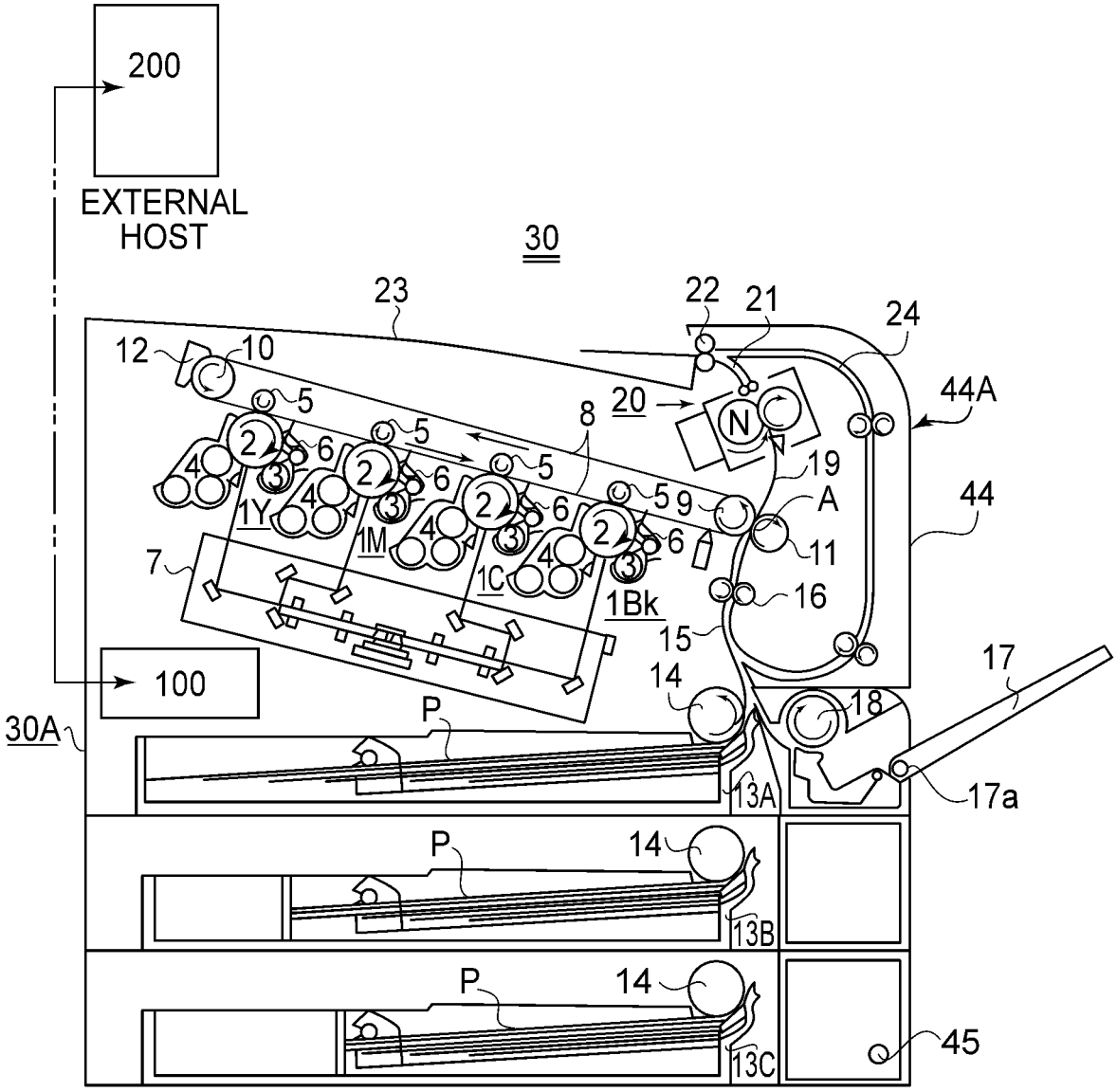
FIG. 2 is a schematic sectional view of the image forming apparatus in the first embodiment, at a vertical plane parallel to the recording sheet conveyance direction, as seen from the front side of the apparatus.

FIG. 2 is a schematic sectional view of the image forming apparatus 30 in the first embodiment of the present invention. The image forming apparatus 30 is an example of electrophotographic full-color printer. It has a fixing apparatus 20, which is an image heating apparatus which is in accordance with the present invention. FIG. 2 shows the general structure of the image forming apparatus 30. To begin with, the image forming portion of the image forming apparatus 30 is roughly described.

This printer 30 can form a full-color image on a sheet of recording paper, in accordance with the information of an image inputted from an external host apparatus 200 which is in connection to the control circuit portion 100 (controlling means; CPU) in such a manner that communication is possible between the external host apparatus 200 and control circuit portion. The external host apparatus 200 is a computer, an image reader, or the like. The control circuit portion 100 exchanges signals with the external host apparatus 100. It controls an image formation sequence by exchanging signals with the various devices which the image forming apparatus 30 has.

Referring to FIG. 2, "8" stands for an intermediary transfer belt (which hereafter may be referred to simply as belt), which is endless and flexible. The intermediary transfer belt 8 is suspended and tensioned by a pair of rollers, more specifically, a roller 9 which opposes the secondary transfer roller, and a tension roller. As the roller 9 is driven, the intermediary transfer belt 8 is rotationally driven by the roller 9 in the counterclockwise direction indicated by an arrow mark in FIG. 2. "11" stands for the secondary transfer roller, which is positioned so that it is kept pressed against the above-mentioned roller 9 with the presence of the intermediary transfer belt 8 between the two rollers 9 and 11. The area of contact (transfer nip) between the belt 8 and secondary transfer roller 11 is the secondary transferring portion A (first position).

"1Y, 1M, 1C and 1Bk" stand for the first to fourth image forming portions, respectively, which are sequentially disposed in parallel, in the direction in which the belt 8 is moved, on the bottom side of the belt 8. Each image forming portion is an electrophotographic image forming portion which employs a laser-based exposing method. It has an electrophotographic photosensitive member 2 (which hereafter may be referred to simply as drum), as an image bearing member, which is rotationally driven in the clockwise direction indicated by an arrow mark in FIG. 2, at a preset speed. Further, each image forming portion has a primary charging device 3, a developing device 4, a transfer roller 5 (as transferring means), and a drum cleaner 6, which are disposed in the adjacencies of the peripheral surface of the photosensitive drum 2 in a manner to surround the photosensitive drum 2.

Each transfer roller 5 is disposed on the inward side of the loop (belt loop) which the belt 8 forms. It is kept pressed against the corresponding drum 2 with the presence of the portion of the belt 8, which corresponds to the bottom portion of the belt loop, between the transfer roller 5 and drum 2. The area of contact between the belt 8 and drum 2 is the primary transferring portion. "7" stands for a laser-based exposing apparatus for exposing the drum 2 of each image forming portion. The exposing apparatus 7 is made up of a light emitting means, a polygon mirror, a reflection mirror, etc. The exposing apparatus 7 emits a beam of laser light while modulating the beam according to the information of the image to be formed, more concretely, with sequential, electrical, and digital signals, which represent the picture elements, one for one, of which the image is to be formed.

The control circuit portion 100 makes each image forming portion carry out an image forming operation, in response to the image formation signals which correspond to monochromatic images (yellow (Y), magenta (M), cyan (C), and black (Bk) images) into which the image to be formed has been separated, and which are inputted from the external host apparatus 200. Consequently, yellow (Y), magenta (M), cyan (C), and black (Bk) toner images are formed on the peripheral surfaces of the rotating photosensitive drums 2, in the first and fourth image forming portions 1Y, 1M, 1C and 1Bk, respectively. By the way, the electrophotographic image formation principle based on which a toner image is formed on the photosensitive drum 2, and the process for electrophotographically forming an image on the photosensitive drum 2, are well-known, and therefore, are not described here.

The above-described toner images formed on the peripheral surfaces of the drums 2 in the four image forming portions, one for one, are sequentially transferred in layers onto the outward surface of the belt 8, in the primary transferring portions, while the belt 8 is rotationally driven in the same direction as the direction in which the peripheral surface of each photosensitive drum 2 moves in the primary transferring portion, at the same speed as the peripheral velocity of each photosensitive drum 2. Consequently, an unfixed full-color toner image is synthetically formed of the four monochromatic images, different in color, on the outward surface of the belt 8 in terms of the belt loop.

Meanwhile, a feed roller 14 of the selected sheet feeder cassette is driven. More concretely, the image forming apparatus 30 is provided with a recording medium feeding portion in which three sheet feeder cassettes 13A, 13B, and 13C in which multiple sheets of recording medium (which hereafter may be referred to as recording paper, or simply as paper) different in size (in width and length) are storable in layers, can be vertically stacked. Thus, as the feed roller 14 of one of the sheet feeder cassette is driven, one of the sheets P of recording paper in the selected sheet feeder cassette 13 is fed into the main assembly of the image forming apparatus 30 while being separated from the rest of the sheets in the cassette 13. Then, the sheet P of recording paper is conveyed to a pair of registration rollers 16 through a vertical recording paper conveyance passage 15 in the main assembly.

If it is the manual feeding tray 17 that is selected as a sheet feeding means, a feed roller 18 is driven, whereby one of the sheets S of recording paper stack on the manual feeding tray 17 (multi-purpose tray) is fed into the main assembly of the image forming apparatus 30 while being separated from the rest of the sheets on the tray 17. Then, the sheet S is conveyed to the pair of registration rollers 16 through the vertical sheet conveyance passage 15.

The pair of registration rollers 15 begin to be rotated to convey the sheet P of recording paper, with such timing that the leading edge of the aforementioned full-color toner image on the rotationally moving belt 8 arrives at the secondary transferring portion A at the same time as the leading edge of the sheet P. Thus, the four monochromatic toner images, different in color, on the belt 8, of which the full-color toner image on the belt 8 is formed, are transferred together (secondary transfer) onto the surface of the sheet P as if they are peeled away from the belt 8. After being conveyed out of the secondary transferring portion A, the sheet P is separated from the surface of the belt 8, conveyed through the vertical sheet conveyance passage 19, and then, is introduced into a fixing apparatus 20 (fixing portion).

It is by the fixation nip N (second position) that the abovementioned four monochromatic toner images, different in color, (Y, M, C and Bk colors) on the sheet P of recording paper melt and mix. Then, as the mixture of the four monochromatic toner images, different in color, cools down, it becomes fixed to the surface of the sheet P. After being conveyed through the fixing apparatus 20, the sheet P is discharged as a finished full-color print onto a delivery tray 23 by a pair of discharge rollers 22 through a recording sheet conveyance passage 21. After the separation of the sheet P from the belt 8 in the secondary transferring portion A, the surface of the belt 8, which was bearing the full-color toner image, is cleaned by a belt cleaning apparatus 12; the residues such as toner particles remaining on the surface of the belt 8 after the secondary transfer are removed so that the belt 8 can be repeatedly used for image formation.

When the image forming apparatus 30 is in the monochromatic (black-and-while) mode, only the fourth image forming portion Bk, which is for forming a black (Bk) toner image, is activated and controlled for image formation.

When the selected printing mode is the two-sided printing mode, a sheet P of recording paper is conveyed toward the delivery tray 23 by the pair of discharge rollers 22 after an image is fixed to the first surface of the sheet P. Then, the pair of discharge rollers 22 are reversed in rotation at a point in time when the trailing edge of the sheet P almost moves out of the nip between the pair of discharge rollers 22. Thus, the sheet P is changed in the direction and is introduced into a sheet reconveyance passage 24, being thereby placed upside down. Then, it is reconveyed to the pair of registration rollers 16. Then, it is conveyed through the secondary transferring portion A and fixing apparatus 20 as it was when an image was formed on its first surface. Then, it is discharged as a two-sided print onto the delivery tray 23.

As described above, the printer 30 in this embodiment has the image forming portion which forms a toner image on a sheet P of recording paper, in the first position A (secondary transferring portion A), and the fixing portion (fixing apparatus) in which it fixes the toner image formed on the sheet P by the image forming portion, in the second position N (fixation nip N).

Further, the printer 30 in this embodiment has the vertical sheet conveyance passage 19 through which a sheet P of recording paper is conveyed. In this printer 30, a sheet P of recording paper is conveyed vertically upward from the transfer nip portion A to the fixation nip N through the sheet conveyance passage 19. That is, the fixation nip N is above the transfer nip A.

(2) Fixing Apparatus 20

In the following description of this embodiment, the lengthwise direction (widthwise direction) of the fixing apparatus 20 and/or the structural members of the fixing apparatus 20 is such a direction that is parallel to the direction which is perpendicular to the direction in which a sheet of recording paper is conveyed through the recording paper conveyance passage. The front side of the fixing apparatus 20 is the side of the fixing apparatus 20, from which a sheet P of recording paper is introduced into the fixing apparatus 20. The left and right sides of the fixing apparatus 20 are the left and right sides, respectively, of the fixing apparatus 20 as the fixing apparatus 20 is seen from its front side. The width of a sheet P of recording paper is the dimension of the sheet P in terms of the direction perpendicular to the recording paper conveyance direction.

Figure 3:
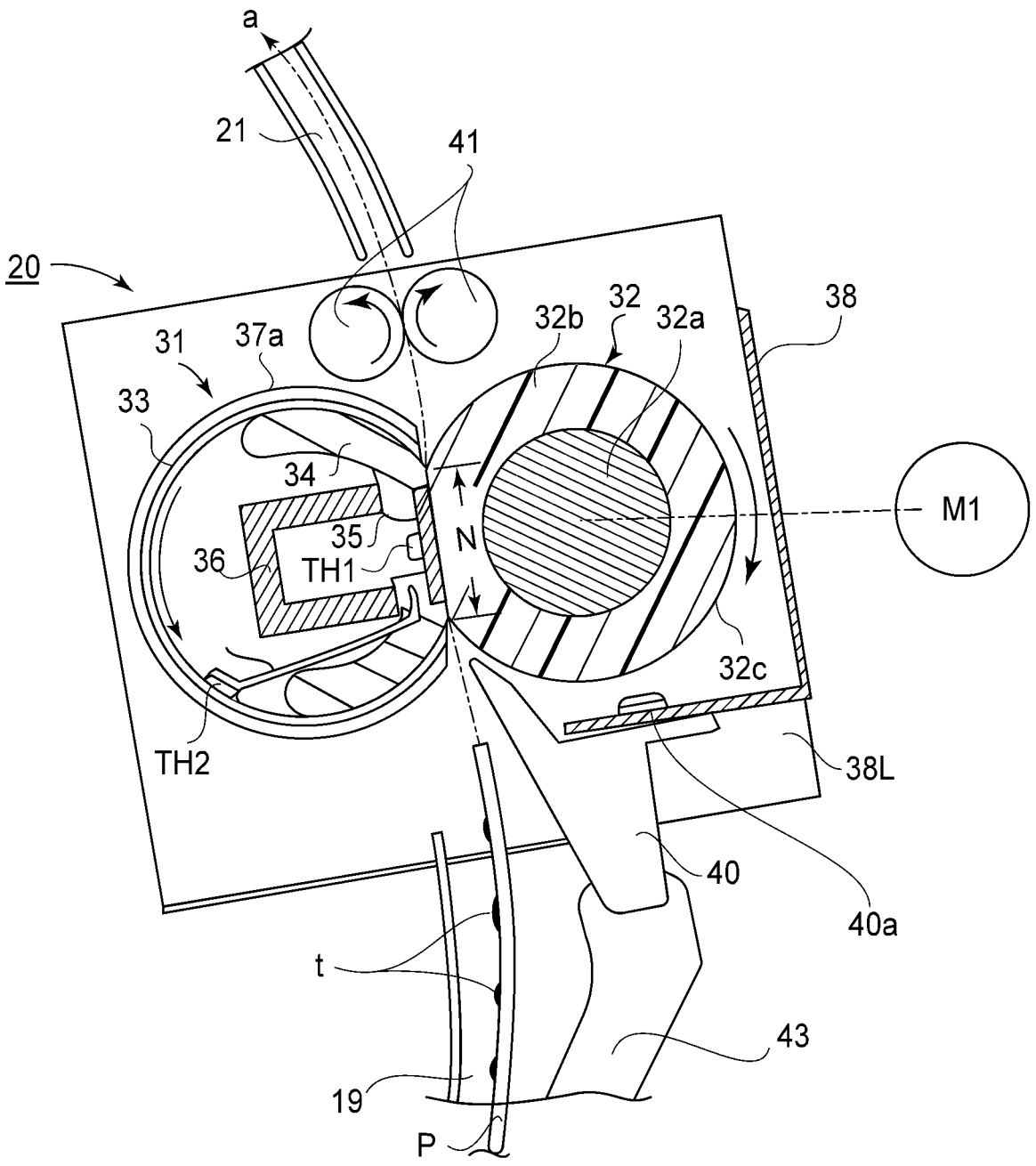
FIG. 3 is an enlarged schematic sectional view of the fixing apparatus, and its adjacencies, of the image forming apparatus shown in FIG. 2, at a vertical plane.

FIG. 3 is an enlarged schematic sectional view of the fixing apparatus 20 shown in FIG. 2, and its adjacencies, at a vertical plane. Part (a) of FIG. 4 is a schematic front view of a combination (fixation system portion 20A) of the fixation belt assembly and pressure roller portion of the fixing apparatus 20, and its adjacencies. Part (b) of FIG. 4 is a schematic front view of the combination, and its adjacencies. FIG. 5 is a block diagram of the portion of the control system of the image forming apparatus 30, which is for controlling the fixing apparatus 20.

This fixing apparatus 20 is basically the same as the one disclosed in Japanese Laid-open Patent Application No. H04-44075-44083 and H04-204980-204984, etc. It is of the so-called belt (film) heating type. Further, it is of the type which drives a pressure application rotational member (tensionless type). Moreover, it is of the so-called on-demand type. "31" stands for a fixation belt assembly, and "32" stands for an elastic pressure roller, which is a pressure applying rotational member. The fixing apparatus 20 is structured so that the fixation belt assembly 31 and pressure roller 32 are kept pressed upon each other to form and maintain the fixation nip N between them.

Regarding the fixation belt assembly 31, "33" stands for a fixation belt (which hereafter may be referred to simply as belt). The belt 33 is cylindrical (endless, and in the form of a sleeve) and flexible. It is a rotational heating member. "34" stands for a belt guiding member (which hereafter may be referred to simply as guiding member), which is heat-resistant and rigid. The guiding member 34 is roughly semicircular in cross-section as shown in the drawings. "35" stands for a ceramic heater (which hereafter will be referred to simply as heater) as a heat source (heating member). The heater 35 is fixed to the guiding member 34. More specifically, the guiding member 34 is provided with a groove which extends in the lengthwise direction of the guiding member 34, and the heater 35 is fitted in this groove. The belt 33 is loosely fitted around the guiding member 34 which is fitted with the heater 35.

Regarding also the fixation belt assembly 31, "36" stands for a pressure application stay (which hereafter will be referred to simply as stay), which is rigid and U-shaped in cross section. The stay 36 is disposed on the inward side of the guiding member 34. The stay 36 is provided with a pair of arms 36*a*, which make up the left and right end portions of the stay 36. "37" stands for a holder, with which each of the arms 36*a* is fitted. "37*a*" stands for a flange, which is one of the integral parts of the holder 37.

The belt 33 is multilayered, having a base layer, an elastic layer, a release layer, etc. Normally, the base layer is formed of heat-resistant resinous or metallic substance. The elastic layer is placed on the base layer. The release layer is placed on the elastic layer. The belt 33 is desired to be such a member that is high in thermal conductivity, and low in thermal capacity, in overall property.

The heater 35 is a thin, flat, and rectangular heating member, and is disposed in such an attitude that after the assembly of the fixing apparatus 20, its lengthwise direction is perpendicular to the direction in which a sheet P of recording paper is conveyed through the fixation nip N. Basically, it is made up of a substrate, and a heat generation layer formed on the substrate. The substrate is formed of such ceramic as aluminum nitrate, alumina, or the like. The heat generation layer is formed of silver-palladium, which generates heat as electric current is flowed through it. The material, properties, etc, of a ceramic heater are well-known, and therefore, are not described in detail, here.

The pressure roller 32 is made up of a metallic core 32*a*, and an elastic layer formed of silicone rubber or the like, on the peripheral surface of the metallic core 32*a* to reduce the roller 32 is hardness. From the standpoint of improving the pressure roller 32 in surface properties, the pressure roller 32 may be provided with a layer of fluorine resin such as PTFE, PFA, FEP or the like, which covers the peripheral surface of the elastic layer 32*b*. The pressure roller 32 is rotatably supported by the left and right side plates 38L and 38R of the frame 38 of the fixing apparatus 20, between the two plates 38L and 38R. More concretely, each of the side plates 38*a* and 38*b* is provided with a bearing 39, and the left and right end portions of the pressure roller 32 are supported the pair of bearing 32, one for one. By the way, referring to FIGS. 3 and 8, the frame 38 extends in the lengthwise direction (width direction) of the fixing apparatus 20.

The fixing apparatus 20 is structured so that the fixation belt assembly 31 is disposed in parallel to the above-described pressure roller 32, with its heater side facing the pressure roller 32, and also, that the left and right end holders 37 are kept pressured toward the axial line of the pressure roller 32 by a preset amount of force F (FIG. 4) generated by an unshown pressure applying mechanism. Thus, the surface of the heater 35 is kept pressed against the pressure roller 32, with the presence of the belt 33 between the heater 35 and pressure roller 32. That is, the fixation belt assembly 31 is kept pressed against the pressure roller 32 in a manner to compress the elastic layer 32*b* of the pressure roller 32 against the elasticity of the elastic layer 32*b*. Thus, the fixation nip N which is necessary for thermal fixation is formed and maintained between the belt 33 and pressure roller 32. In terms of the recording paper conveyance direction, the fixation nip N is provided with a preset width. The pressure applying mechanism has a pressure removing mechanism, which is for removing pressure from the fixation nip N to make it easier for a user to remove a sheet P of recording paper remaining pinched (jammed) in the fixation nip N.

"40" stands for an entrance guide attached to the frame 38. "41" stands for one of the pair of discharge rollers with which the fixing apparatus 20 is provided. The entrance guide 40 plays the role of guiding a sheet P of recording paper so that the sheet P is precisely guided into the fixation nip N of the fixing apparatus 20 after being guided to the fixing apparatus 20 by the vertical sheet conveyance passage 19.

"G" stands for a drive gear fixed to one of the lengthwise ends of the metallic core 32*a*. As rotational driving force is transmitted to this gear G from the fixation motor M1 through an unshown driving force transmission mechanism, the pressure roller 32 is rotationally driven in the clockwise direction indicated by an arrow mark in FIG. 3. As the pressure roller 32 is rotationally driven, friction is generated between the pressure roller 32 and the outward surface of the belt 33, in the fixation nip N. This friction works as the force for rotationally driving the belt 33. Thus, the belt 33 rotates around the guiding member 34 in the counterclockwise direction indicated by an arrow mark, with its inward surface sliding on the heater 35 while remaining airtightly in contact with the heater 35, in the fixation portion N (pressure roller driving method).

The belt 33 rotates with at a peripheral velocity which is roughly equal to the peripheral velocity of the pressure roller 32. As the belt 33 rotates, it is likely to deviate leftward or rightward in the lengthwise direction of the guiding member 34. Thus, the left and right flanges 37*a* play the role of catching the belt 33 by the corresponding edge of the belt 33 to regulate the belt deviation. The inward surface of the belt 33 is coated with grease (lubricant) to ensure that the belt 33 smoothly slides on the heater 35 and guiding member 34.

As a sheet P of recording paper is introduced into the fixation nip N, it is nipped between the pressure roller 32 and belt 33. Then, it is conveyed through the nip N by the rotation of the pressure roller 32 and belt 33. In this embodiment, the image forming apparatus is of the so-called center reference conveyance type. That is, it structured so that when a sheet P of recording paper is conveyed through the fixing apparatus (image forming apparatus), the center line of the sheet P and that of the belt 33 remain coincidental with each other, in terms of the widthwise direction of the sheet P, regardless of sheet size. "S" stands for the central referential line (hypothetical line).

"TH1 and TH2" stand for two thermistors, more specifically, the first (main) and second (subordinate) thermistors, respectively, as temperature detecting means. The main thermistor TH1 is disposed in contact with roughly the center portion (in terms of the lengthwise direction of the heater 35) of the back surface of the heater 35, in order to ensure that it detects the temperature of the portion of the heater which is in the recording sheet path regardless of sheet size.

The subordinate thermistor TH2 is for detecting the temperature of the portion of the belt 33, which is out of the sheet path when a sheet P of recording paper which is narrower than the widest sheet P of recording paper conveyable through the fixing apparatus (image forming apparatus) is conveyed. Thus, it is disposed in such a manner that it remains in contact with the inward surface of the belt 33 even if the belt 33 moves in the direction perpendicular to the sheet bearing surface of the belt 33.

As electric current is flowed through the heat generating layer of the heater 35 (which is on the substrate of the heater 35) from the heater driving circuit 92 (FIG. 5), as an electric power supplying portion, the heat generating layer generates heat, causing the heater 35 to quickly increase in temperature across the entirety of its heat generating portion in terms of its lengthwise direction. The heater temperature is detected by the main thermistor TH1, and the electrical information related to the heater temperature is inputted into the control circuit 100 by way of an A/D converter 81. Meanwhile, the belt temperature is detected by the subordinate thermistor TH2, and the electrical information regarding the temperature of the belt 33 is inputted into the control circuit 100 by way of the A/D converter 82.

The control circuit 100 controls the power supply from the heater driving circuit 92 to the heater 35, based on the output of the main thermistor TH1 and that of the subordinate thermistor TH2. That is, it controls the heater in temperature so that the heater temperature detected by the main thermistor TH1 remains at a preset level (fixation temperature).

Further, the control circuit 100 begins rotationally driving the pressure roller 32, by controlling the fixation motor driving circuit 91, based on the print signals from the external host apparatus, or other control signals. Moreover, it begins to increase the amount by which the heater 35 generates, by controlling the heater driving circuit 92. As the belt 33 stabilizes in rotational speed, and the temperature of the heater 35 increases to, and remains at, a preset level, a sheet P of recording paper bearing an unfixed toner image t is introduced into the fixation nip N from the image forming portion side, while being guided by the entrance guide 40, in such an attitude that the surface of the sheet P, on which the toner image is present, faces the belt 33.

In the fixation nip N, the sheet P of recording paper is moved with the belt 33 through the fixation nip N, while remaining pressed against the heater 35 with the presence of the belt 33 between the heater 35 and sheet P. While the sheet P is conveyed through the fixation nip N, heat is given to the sheet P by the belt 33 which is being heated by the heater 35. Consequently, the toner image t is thermally fixed to the surface of the sheet P. After being conveyed through the fixation nip N, the sheet P is separated from the surface of the belt 33, and is conveyed further to be discharged from the image forming apparatus 30.

(3) Door 44

The main assembly 30A of the printer 30 is provided with an opening 30B (FIG. 6A), which is a part of the right wall of the main assembly 30A. By the way, the "right wall" means one of the vertical walls of the apparatus main assembly 30A, which is at the right end of the main assembly 30A when the printer 30 is seen from the front side. Further, the apparatus main assembly 30A (printer main assembly) is provided with a door 44 (member which can be opened or closed), which can be moved into a closed position 44A (FIG. 2), in which it covers the opening 30B in a preset manner, or an open position 44B (FIG. 6A), in which it keeps the opening 30B exposed in a preset manner. For the sake of weight reduction, the door 44 is formed of a resinous substance.

As will be described later, the image forming apparatus 30 is structured so that the post-transfer guide 43 is moved by the opening or closing of the door 44. More concretely, as the door 44 is opened, that is, as the door 44 is changed in attitude from the closed attitude 44A to the open attitude 44B, the post-transfer guide 44 moves with the door 44. In other words, the image forming apparatus 30 is structured so that as the door 44 is opened, the vertical sheet conveyance passage, which includes the vertical sheet conveyance passage 19, is exposed, while the fixing apparatus 20 and entrance guide 40 remain in the apparatus main assembly 30A.

The manual feeding tray 17 is attached to the outward side of the door 44. More concretely, it is hinged to the shaft 17*a* of the apparatus main assembly 30A by its bottom edge portion, being thereby made pivotally movable about the shaft 17*a*. Thus, when it is not in use, it can be folded up against the outward surface of the door 44 (FIG. 6A).

If a sheet P of recording paper becomes jammed in the vertical sheet conveyance passage 19 during an image forming operation, a user is to open the door 44 to expose a part of the recording paper conveyance passage (which includes the vertical sheet conveyance passage 19), in order to remove the jammed sheet P from the printer 30.

The procedure to expose the vertical sheet conveyance passage 19 is as follows. First, a user is to release the door 44 from the door locking portion (unshown) of the door 44. Then, the user is to pivot the door 44 about the shaft 45 to change the door 44 in attitude from the closed one 44*a*, shown in FIG. 2, to the open one 44*b*, shown in FIG. 6A. The apparatus main assembly 30A is provided with a door stopper (unshown) so that as the door 44 is pivoted to the open attitude 44B, it cannot be pivoted further, and is kept in the open attitude.

Further, the image forming apparatus 30 is structured so that when the door 44 is open, the sheet reconveyance passage 24, right registration roller 16, secondary transfer roller 11, and top discharge roller 22 are on the inward side of the door 44, and also, so that the right guide which makes up a part of the right side of the sheet conveyance passage which extends from the sheet feeder cassettes 13A, 13B, and 13C through the vertical sheet conveyance passage 15, vertical sheet conveyance passage 15, and vertical sheet conveyance passage 19, is on the inward side of the door 44.

Therefore, as the door 44 is opened, the recording paper conveyance passage, which extends from each of the sheet feeder cassettes 13A, 13B, and 13C to the pair of discharge rollers 22 is exposed, except for the inside of the fixing apparatus 20. Thus, it becomes possible for a user to easily access the sheet conveyance passage which extends from the feed roller 14 of each of the sheet feeder cassettes 13A, 13B, and 13C to the pair of discharge roller 22, as well as the reconveyance passage 24, through the space between the open door 44 and the apparatus main assembly 30A, to remove the jammed sheet P of recording paper. The jammed sheet P of recording paper remaining pinched in the fixation nip N of the fixing apparatus 20 can be easily removed by removing the pressure from the pressure applying mechanism, with the use of the pressure removing mechanism.

After the removal of the jammed sheet of recording paper, a user is to pivot the open door 44 about the shaft 45 in the upward direction, that is, the opposite direction from the direction in which it was opened, to erect the door 44 so that the door 44 is folded up against the apparatus main assembly 30A. As the door 44 is completely folded up, the sheet conveyance passage is reconstituted, and the door 44 is locked to the apparatus main assembly 30A, being thereby put in the closed attitude. In other words, the image forming apparatus 30 is restored for image formation.

This embodiment is not intended to limit the present invention in scope in terms of the mechanism, with which an image forming apparatus is provided to enable its door to be opened or closed. For example, the present invention is also compatible to an image forming apparatus provided with "Accuslide rails" or the like to which the door 44 is mountable so that the door 44 can be horizontally moved relative to the apparatus main assembly 30A to be opened or closed.

(4) Vertical Sheet Conveyance Passage 19

The surface of one of the walls of the vertical sheet conveyance passage 19 which conveys a sheet P of recording paper from the secondary transferring portion A to the fixing apparatus 20 is structured as shown in FIGS. 3 and 7. More specifically, it is made up of the entrance guide 40 (first guide) attached to the frame 38 (supporting member) of the fixing apparatus 20, and the post-transfer guide 43 (second guide) attached to the door 44. Thus, as the door 44 is opened or closed, the post-transfer guide 43 moves with the door 44. FIG. 7 is a schematic side view of the joint between the entrance guide 40 and post-transfer guide 43, as seen from the left side of the printer 30 when the door 44 is remaining closed. It shows the positional relationship between the entrance guide 40 and post-transfer guide 43 when the door 44 is remaining closed. By the way, the left side of the printer 30 is the left portion of the printer 30 as seen from the front side of the printer 30. The front side of the sheet of paper having FIG. 7 corresponds to the front surface of the vertical sheet conveyance passage 19. Each sheet P of recording paper is conveyed upward (indicated by arrow mark a) of FIG. 7, within an area R. In terms of the widthwise direction of the fixing apparatus 20, the area R is the area within which a sheet P of recording paper is guided by the sheet conveying surface of the post-transfer guide 43 and the surface of the entrance guide 40 (recording paper conveyance area).

The entrance guide 40 is formed of a heat-resistant resinous substance such as PBT and LCP. It is attached to the metallic frame 38, by its lengthwise end portions 40*a*. That is, the frame 38 is a supporting plate which supports the entrance guide 40.

In this embodiment, the frame 38 is formed of cold rolled sheet of steel. The frame 38 extends in the direction parallel to the lengthwise (widthwise) direction of the fixing apparatus 20. It is by the left and right side plates 38L and 38R that the pressure roller 32 is rotatably supported as described above. The left and right side plates 38L and 38R are in connection to the frame 38. The anchoring portion 40*a* is a part of the entrance guide 40, which was in the shape of a hook. It is anchored to the frame 38 by being fitted into the hole with which the frame 38 is provided. From the standpoint of ensuring that a sheet P of recording paper is flawlessly (without being wrinkled, for example) conveyed through the sheet conveyance passage, and also, that a sheet P of recording paper remains stable in attitude while being conveyed, it is desired that the downstream edge of the post-transfer guide 43 in terms of the recording paper conveyance direction a is positioned as close as possible to the sheet guiding surface of the entrance guide 40.

As the door 44 is opened or closed, the post-transfer guide 43 attached to the door 44 moves with the door 44. However, the entrance guide 40 attached to the fixing apparatus 20 does not move with the door 44. Thus, the positional relationship between the two guides 43 and 40 is likely to be unstable. Therefore, if the two guides 43 and 40 are positioned too close to each other, it is possible that as the door 44 is opened or closed, the post-transfer guide 43 will collide with the entrance guide 40.

Thus, the post-transfer guide 43 is provided with a preset number of protrusions which protrudes downstream, like the teeth of a comb, from the downstream edge of the post-transfer guide 43 in terms of the recording paper conveyance direction, whereas the upstream edge portion of the entrance guide 40 is provided with a preset number of such protrusions that protrude upstream, like the teeth of a comb. In terms of the lengthwise direction of the two guides 43 and 40, the protrusions (teeth) of the former and those of the latter are positioned so that as the door 44 is closed, the downstream edge portion of the post-transfer guide 43 meshes with the upstream edge portion of the entrance guide 40, in such a manner that the two edge portions overlap with each other as seen from the direction parallel to the lengthwise (widthwise) direction of the fixing apparatus 20. Thus, even though the apparatus main assembly 30A is structured so that when the door 44 remains closed, the post-transfer guide 43 and entrance guide 40 overlap with each other in terms of their lengthwise direction, it does not occur that as the door 44 is closed, the post-transfer guide 43 and entrance guide 40 collide with each other. Therefore, as the door 44 is closed, the two guides 43 and 40 provide a practically continuous sheet conveyance surface (recording sheet guiding surface), ensuring that each sheet P of recording paper is flawlessly conveyed through the vertical sheet conveyance passage 19. By the way, "post-transfer guide 43 and entrance guide 40 overlap with each other" means that the protrusions of the post-transfer guide 43 overlap with the protrusions of the entrance guide 40 as the two guides 43 and 40 are seen from the direction which is perpendicular to the direction a, in which a sheet P of recording paper is conveyed along the sheet conveyance surface.

More concretely, referring to FIG. 7, the post-transfer guide 43 is provided with a preset number of protrusions (designated by referential code 43*a* in FIG. 7), which protrude downstream in terms of the recording paper conveyance direction a (that is, toward fixation nip N). On the other hand, the entrance guide 40 is provided with a preset number of protrusions (designated by referential code 40*b* in FIG. 7) which protrude upstream in terms of the recording paper conveyance direction a. The printer 30 is structured so that when the door 44 is remaining closed, the protrusions 40*b* of the entrance guide 40 and those 40*a* of the post-transfer guide 43 are alternately positioned in terms of the lengthwise direction of the two guides 43 and 40. Therefore, as (when) the door 44 is closed, the two guides 43 and 40 provide a practically continuous recording paper guiding surface (recording medium guiding surface). Further, referring to FIG. 7, the entrance guide 40 is provided with a preset number of protrusions 40*b*, whereas the post-transfer guide 43 is provided with a preset number of protrusions 40*a*, which correspond in position to the gaps (intervals) of the protrusions 4*a* of the entrance guide 40, one for one. Thus, as (when) the door 44 is closed, the protrusions 43*a* of the post-transfer guide 43 are allowed to fit into the gaps (intervals) of the protrusions 40*b* of the entrance guide 40, one for one, in such a manner that they overlap as seen from the direction which is parallel to the lengthwise direction of the fixing apparatus 20 (post-transfer guide 43 and entrance guide 40 are allowed to overlap with each other).

By the way, the present invention is also applicable to an image forming apparatus structured as follows, as long as the apparatus is structured so that as (when) the door 44 is closed, the protrusions of the post-transfer guide 43 mesh into the recesses of the entrance guide 40, one for one (or protrusions of entrance guide 40 mesh into recesses of post-transfer guide 43, one for one) so that the combination of two guides 43 and 40 provide a virtually continuous recording paper guiding surface. The present invention is also applicable to an image forming apparatus structured so that some protrusions of the post-transfer guide 43 do not mesh into the recesses of the entrance guide 40 (number of protrusions which post-transfer guide 43 has is smaller than the number of recesses which entrance guide 40 has). Even in such a case, the protrusions of the post-transfer guide 43 mesh into the recesses of the entrance guide 40, one for one, leaving some recesses of the entrance guide 40 with no counterpart (protrusion of post-transfer guide 43). Moreover, the present invention is also applicable to an image forming apparatus structured so that the number of the recess of the post-transfer guide 43 is greater than the number of the protrusions of the entrance guide 40, and therefore, some recesses of the post-transfer guide 43 are left with no counterpart (protrusion of entrance guide 40).

However, an image forming apparatus structured so that the guide 43 mesh with guide 40 has the following problem. That is, it occurs sometimes that while the aforementioned portion of the recording medium conveyance passage is left open (door 44 was opened to remove jammed sheet of recording paper, and therefore, post-transfer guide 43 is in its open position), a sheet P of recording paper enters the area in which the two guides 43 and 40 will overlap with each other as the door 44 is closed, due to an operational error or the like committed by a user. In such case, if the door 44 is closed, and therefore, the post-transfer guide 43 is moved back from its open position to its closed position, the sheet P is sandwiched between the two guides 43 and 40, in the area where the two guide 43 and 43 will overlap with each other, making it impossible for the protrusions of the post-transfer guide 43 to mesh into the recesses (gaps (intervals) among protrusions) of the entrance guide 40. Thus, the guides 43 and/or 40 sometimes are deformed or damaged by the force to which they are subjected through the sheet P.

Next, referring to FIG. 8, how the guides are damaged by the force they are subject through a sheet P of recording paper is described. Part (a) of FIGS. 8~8*f*) are schematic sectional views of the portions of the image forming apparatus in this embodiment related to the present invention, at a plane perpendicular to the lengthwise (widthwise) direction of the fixing apparatus 20. They sequentially show the changes in the positional relationship between the entrance guide 40 and post-transfer guide 43, which occur as the door 44 is opened to remove the jammed sheet P of recording paper, and closed to ready the printer 30, and the resultant interference attributable to the sheet P. That is, they show the state of the two guides 43 and 40 as seen from the direction (widthwise direction) perpendicular to the recording paper conveyance direction a. Parts (a) and (b) of FIG. 8 are related to a case where there is no sheet P of recording paper between the two guides 43 and 40. Parts (c), (d), (e) and (f) of FIG. 8 are related to a case where a sheet P of recording paper is stuck in the vertical recording sheet conveyance passage.

To begin with, referring to parts (a) and (b) of FIG. 8, the changes which occur to the positional relationship between the two guides 43 and 40 as the door 44 is moved are described. Referring to part (a) of FIG. 8, while the door 44 remains closed, the entrance guide 40 and post-transfer guide 43 remain overlapped (meshed) with each other, providing thereby one of the sheet guiding surfaces of the vertical conveyance passage 19.

Referring to part (b) of FIG. 8, on the other hand, as the door 44 is opened, the post-transfer guide 43 moves with the door 44. Thus, as the door 44 is opened as shown in part (b) of FIG. 8, the post-transfer guide 43 is moved away from the entrance guide 40. Therefore, when the door 44 is open, the post-transfer guide 43 does not overlap with the entrance guide 40, exposing thereby the vertical sheet conveyance passage 19. By the way, the entrance guide 40 does not move with the door 44. Therefore, it is possible for a user to easily access the vertical sheet conveyance passage 19 as a sheet P of recording paper jammed the fixing apparatus 20.

Next, referring to parts (c) and (d) of FIG. 8, a case in which the changes in the positional relationship between the two guides 43 and 40, which occur as the door 44 is moved, causes a sheet P of recording paper to interfere with the overlapping (meshing) of the two guides 43 and 40 with each other, is described. Referring to part (c) of FIG. 8, if a sheet P of recording paper stuck in the fixing apparatus 20, and therefore, a part of the sheet P remains in the vertical sheet passage 19, the sheet P has to be removed. Thus, the door 44 is to be moved (opened) to expose the vertical sheet passage 19 as shown in part (d) of FIG. 8, so that the trailing end portion of the sheet P can be grabbed by a user to pull the sheet P out of the fixing apparatus 20. However, it is possible that when the door 44 is open, and a user is trying to remove the jammed sheet P, the trailing end portion of the sheet P will be unintentionally moved into the space between the entrance guide 40 and post-transfer guide 43 by the user.

Moreover, referring to part (e) of FIG. 8, if the door 44 is closed while a sheet P of recording paper is between the entrance guide 40 and post-transfer guide 43, the sheet P interferes with the meshing of the protrusions of the post-transfer guide 43 into the corresponding recesses (gaps among protrusions 40*a*) of the entrance guide 40. That is, the door 44 is stopped by the portion of the sheet P, which is between the protrusions 40*b* and corresponding protrusions 40*b*, one for one. If force is applied to the door 4 in the direction to close the door 44 while the part of the sheet P is between the protrusions 40*b* and protrusion 40*a*, the force is transmitted from the post-transfer guide 43 to the entrance guide 40 through the portion of the sheet P, which is between the protrusions 40*b* and protrusions 40*a*, making it possible that the anchoring portions 40*a* of the entrance guide 40 will be deformed or damaged by the force.

Part (f) of FIG. 8 is a schematic drawing for showing the path through which the force applied to the door 44 to close the door 44 while a part of the sheet P is between the protrusions 40*a* and protrusions 40*b* is transmitted to the anchoring portions 40*a* of the entrance guide 40. In a case where the part of the sheet P is between the two guides 43 and 40, as the door 44 is closed, the post-transfer guide 43 applies a force F1 to a point Q (pressure application point) of the entrance guide 40 through the sheet P. As the entrance guide 40 catches the force F1, force F1 acts as such a moment that works in the direction to cause the entrance guide 40 to rotate about the edge 47 of the frame 38. Thus, the anchoring portion 40*a* is made to act like a pressure point, and therefore, is subjected to force F2.

Generally speaking, the damage to a component formed of a resinous substance is attributable to tensional stress. Therefore, if the direction of force F2 is such that the entrance guide 40 is pressed on the frame 38, force F2 subjects the anchoring portion 40*a* to compressive stress, and therefore, it is unlikely for the anchoring portion 40*a* to be damaged by force F2 (F1). On the other hand, if the direction of force F2 is such that force F2 works in the direction to pull the entrance guide 40 away from the frame 38, force F2 subjects anchoring portion 40*a* to tensional stress, and therefore, it is possible that the anchoring portion 40*a* will be damaged.

L1 stands for a line which horizontally extends leftward from the point Q of contact. L2 stands for a line which extends rightward from the edge 47 and is coincident with the anchoring portion 40*a*. The direction (compressive or tensional) in which force F2 works is determined by whether or not line L1 intersects with line L2. In a case where lines L1 and L2 intersect with each other, force F2 works in the direction to compress the anchoring portion 40*a*. In a case where lines L1 and L2 do not intersect with each other, force F2 subjects the anchoring portion 40*a* to tensional stress, making it possible for the anchoring portion 40*a* to break.

Figure 1:
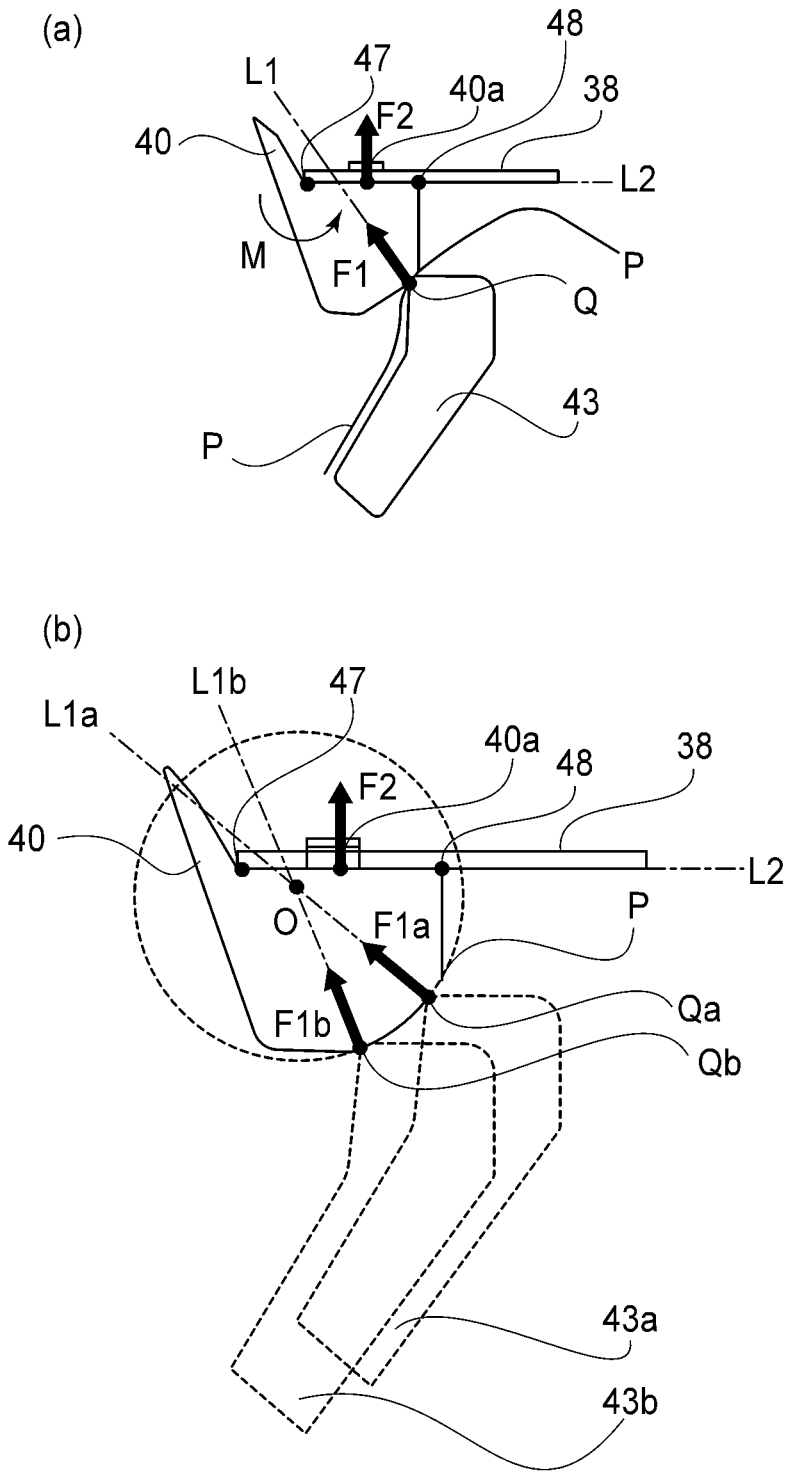
FIG. 1 is a schematic drawing of the portion of the image forming apparatus in the first embodiment of the present invention, to which the present invention is related.

Thus, it is desired to realize such an image forming apparatus that is simple in structure, is structured so that its guides 40 and 43 (guiding members) mesh with each other, and yet, the guides 40 and 43 are not damaged by a sheet of recording paper which is present between the two guides 40 and 43. FIG. 1 shows the configuration of the sheet guiding portion of the image forming apparatus in this embodiment. In a case where the two guides are shaped and positioned as shown in part (a) of FIG. 1, lines L1 and L2 intersect with each other. Thus, force F2 subjects the anchoring portion 40*a* to compressive stress. Therefore, this structural arrangement can prevent the guide from being damaged.

Next, referring to part (b) of FIG. 1, a concrete shape in which the entrance guide 40 has to be to make line L1 and L2 intersect with each other as shown in part (a) of FIG. 1 is described. FIG. 1 is a projection of a combination of the entrance guide 40, post-transfer guide 43, frame 38, etc., upon a vertical plane which is perpendicular to the direction a in which a sheet P of recording paper is guided by the sheet guiding surface of the entrance guide 40 and that of the post-transfer guide 43.

Referring to FIG. 1, the entrance guide 40 is in such a shape that it contour includes a curved portion Qa-Qb which is in the form of an arc, the center of which is point O, and which is the area (point) of contact between the entrance guide 40 and post-transfer guide 43 (hypothetical area (point) of contact in FIG. 1 (projection)). That is, in the projection of the combination upon the plane which is perpendicular to the direction a in which a sheet P of recording paper is guided by the sheet guiding surface of the entrance guide 40, the outwardly curved portion Qa-Qb is on the rear side of the sheet guiding surface. Referring to FIG. 3, the apparatus main assembly 30A is structured so that the portion of the surface of the frame 38 of the printer 30, which supports the entrance guide 40, is on the top side of this curved portion Qa-Qb.

By the way, the path through which the post-transfer guide 43 moves as the door 44 is opened or closed is affected by the tolerance in the dimension of the structural members of the door 44. However, the printer 30 has to be structured so that as the door 44 is closed, the post-transfer guide 43 comes into contact with the curved portion Qa-Qb of the entrance guide 40. Here, the point of the entrance guide 40, with which the post-transfer guide 43 comes into contact as the door 44 is closed, is the point Q shown in the projection. That is, with reference to the projection, it is the point of the contour of the entrance guide 40, with which the protrusive portion of the post-transfer guide 43 overlaps first, as the door 44 is closed (post-transfer guide 43 is moved toward entrance guide 40).

Further, if it is assumed that there is no friction, the direction in which force is applied to the point of contact between the post-transfer guide 43 and entrance guide 40 by the protrusive portion of the post-transfer guide 43 as the door 44 is closed is parallel to the normal line of the curved portion Qa-Qb. That is, the direction in which force is applied to a given point of the curved portion Qa-Qb is parallel to the normal line to the line which is tangential to the curved portion Qa-Qb, at the hypothetical point of contact between the post-transfer guide 43 and entrance guide 40.

Therefore, the direction in which force F2 is applied to the point of contact between the curved portion Qa-Qb of the entrance guide 40 is coincident with the line which connects the point of contact and the center O of the curvature of the curved portion Qa-Qb. Thus, the printer 30 is structured so that line L1*a*, which is coincident with the direction of force F2 which is applied to point Qa intersects with line L2, which coincident with the direction of an arrow mark F2 which stands for the force which is applied to the point Qb. With the printer 30 being structured as described above, no matter where on the curved portion Qa-Qb of the entrance guide 40 the post-transfer guide 43 comes into contact, line L1 and L2 intersect with each other between the intersection of the line L1*a* and line L2, and the intersection between line L1*b* and line L2.

In this embodiment, the entrance guide 40 is provided with the curved portion Qa-Qb, which is shaped and positioned as described above. Therefore, the path through which the post-transfer guide 43 moves as the door 44 is opened, and the force which is applied to the entrance guide 40 by the post-transfer guide 43 as the door 44 is closed becomes as shown in part (a) of FIG. 1. That is, the entrance guide 40 is provided with the curved portion Qa-Qb, which is the first portion of the entrance guide 40 that the protrusive portion of the post-transfer guide 43 overlaps as the door 44 is closed. Therefore, the projection of a combination of the path of the protrusive portion of the post-transfer guide 43, curved portion Qa-Qb of the entrance guide 40, and frame 38, upon a vertical plane which is perpendicular to the direction a (widthwise direction) in which a sheet P of recording paper is guided by the sheet guiding surfaces of the two guides 40 and 43 becomes as shown in part (a) of FIG. 1.

In this projection, "Q" stands for the point of the entrance guide 40, with which the protrusive portion of the post-transfer guide 43 begins to overlap with the entrance guide 40 as the door 44 is closed. That is, point Q is the first point of the entrance guide 40, at which the protrusive portion of the post-transfer guide 43 begins to overlap with the entrance guide 40, within the recording paper conveyance range P of the entrance guide 40, as the door 44 is closed. This point Q is the point of the entrance guide 40, upon which a sheet P of recording paper is pressed by the post-transfer guide 43, if the door 44 is closed when the sheet P is between the entrance guide 40 and post-transfer guide 43. Line L1 in part (a) of FIG. 1 is a line which is perpendicular to the line which is tangent to the curved portion Qa-Qb, at point Q.

Referring to the projection (FIG. 1*a*), line L2 is such a line that extends from the edge 47 of the frame 38, through the anchoring portion 40*a*. It coincides with the surface of the frame 38, by which the frame 38 supports the entrance guide 40.

Here, the point in time when line L1, which is a hypothetical normal line, intersects with the entrance guide supporting surface of the frame 38, is when line L1 intersects with the portion of the frame 38, which is between the edge 47 and the entrance guide supporting edge 48. At this point in time, force F2 to which the anchoring portion 40*a* is subjected generates compressive stress. Therefore, if the door 44 is closed with the presence of a part of a sheet P of recording paper between the entrance guide 40 and post-transfer guide 43, the curved portion Qa-Qb of the entrance guide 40 is subjected to force F1 by the sheet P. Thus, such moment M that works in the direction to rotate the entrance guide 40 about the edge 47 of the frame 38 in the direction indicated by an arrow mark M is generated in the entrance guide 40 by the force F1 which the entrance guide 40 caught by its portion Qa-Qb. Force F2 to which the anchoring portion 40*a* is subjected generates compressive stress. Therefore, it is unlikely for the entrance guide 40 to be damaged. By the way, in a case where line L1, which is a hypothetical normal line, extends from the edge 47 of the frame 38 in the opposite direction from the door 44 (leftward in part (a) of FIG. 1), and therefore, does not intersect with the entrance guide supporting surface of the frame 38, force F2 works in the direction to rotate the entrance guide 40 in the opposite direction from the one indicated by arrow mark M in part (a) of FIG. 1, about the edge 47 of the frame 38, and therefore, the anchoring portion 40*a* is subjected to tensional stress. Therefore, it is possible for the anchoring portion 40*a* to be damaged.

The structure of the printer 30, which characterizes the present invention, can be summarized as follows. When the door 44 is open, the post-transfer guide 43 remains in the first state in which its portion 43*a*, which is shaped like the teeth portion of a coarsely toothed comb is not in mesh with the counterpart of the entrance guide 40, whereas when the door 44 remains closed, the post-transfer guide 43 remains in the second state, in which its portion 43*a* remains in mesh with the counterpart of the entrance guide 40.

The entrance guide 40 is provided with the coarsely toothed portion, which overlaps (meshes) with the coarsely toothed portion of the post-transfer guide 43. More specifically, at least a portion of the entrance guide 40, which is on the opposite side from its sheet guiding surface, and by which a sheet P of recording paper is not guided, is provided with the coarsely toothed portion, is provided with the curved portion Qa-Qb. The meshing starts across the curved portion Qa-Qb. The profile of the curved portion Qa-Qb is characterized in that, normal line L1*a* to the point Qa, at which the meshing starts as the post-transfer guide 43 changes in state from the first one to the second one, intersects with the frame 38.

Thus, even if the post-transfer guide 43 does not come into contact with the same point of the entrance guide 40, the force to which the anchoring portion 40*a* of the entrance guide 40 is subjected always generates compressive stress in the entrance guide 40. Therefore, it is unlikely for the anchoring portion 40*a* to be damaged.

Embodiment 2

Referring to FIG. 1, which is a projection of the combination of the entrance guide 40, post-transfer guide 43, frame 38, etc., upon a vertical plane, in the first embodiment, the curved portion Qa-Qb of the entrance guide 40, which is the portion of the entrance guide 40, with which the protrusive portion of the post-transfer guide 43 meshes first as the door 44 is closed, is outwardly curved.

Referring to FIG. 9, in the second embodiment, the curved portion Qa-Qb is made straight and slanted, unlike the curved portion Qa-Qb in the first embodiment. Otherwise, the image forming apparatus 30 in the second embodiment is the same in structure as the one in the first embodiment. Thus, it is only the difference of the second embodiment from the first embodiment that is described hereafter. The structural features of the image forming apparatus in this embodiment, which are the same as those in the first embodiment are not described.

FIG. 9 is a projection of a combination of the entrance guide 40, post-transfer guide 43, and frame 38, etc., upon a vertical plane which is perpendicular to the direction a (widthwise direction) in which a sheet P of recording paper is guided by the sheet guiding surface of the entrance guide 40. The entrance guide 40 is so shaped that its contour includes the slanted portion Qa-Qb. The image forming apparatus is structured so that as the door 44 is closed, the post-transfer guide 43 comes into contact with a point (hypothetical point of contact in projection) on the slanted portion Qa-Qb. Further, the image forming apparatus is structured so that the slanted portion Qa-Qb extends in such a direction that the more downstream it is in terms of the direction in which a sheet P of recording paper is guided by the sheet guiding surface of the entrance guide 40, the smaller the distance between the slanted portion Qa-Qb and the opening 30B, which is covered or exposed by the door 44. That is, with reference to the projection of the aforementioned combination upon a plane which is perpendicular to the direction a (widthwise direction) in which a sheet P of recording paper is guided by the sheet guiding surface of the entrance guide 40, the slanted portion Qa-Qb of the entrance guide 40 is on the opposite side of the entrance guide 40 from the sheet guiding surface. Referring to FIG. 3, the printer 30 is structured so that the entrance guide supporting surface of the frame 38 is on the top side of the slanted portion Qa-Qb in terms of the gravity direction.

By the way, although the path of the post-transfer guide 43 changes in position due to the tolerance in the dimension of the structural members of the door 44, the printer 30 is structured so that the initial point of contact between the post-transfer guide 43 and entrance guide 40, which occurs as the door 44 is closed falls between point Qa and point Qb of the slanted portion Qa-Qb. By the way, the point of contact on the path of the post-transfer guide 43 means the point in the projection, which is described next. That is, with reference to the projection, it is the intersection of the path of the protrusive portion of the post-transfer guide 43 and the contour of the entrance guide 40 of the printer 30.

Further, generally speaking, if the presence of friction is ignored, the direction of the force to which a given point of the slanted portion Qa-Qb is subjected as the door 44 is closed is coincident with the normal line to the slanted portion Qa-Qb at the point of contact. That is, the direction in which force is applied to a given point of the slanted portion Qa-Qb of the entrance guide 40 by the protrusive portion of the post-transfer guide 43 as the door 44 is closed is the same as the direction of such normal line to the slanted portion Qa-Qb that is coincident with the point of contact.

By the way, the definition of the normal line to the slanted portion Qa-Qb is as follows. Referring to FIG. 9 which is a projection of the aforementioned combination upon the aforementioned plane, α stands for a point which is on a surface which is coincident with the slanted portion Qa-Qb, and is 1.0 mm from the point of contact in the rightward direction, and β stands for a point on the slanted portion Qa-Qb, which is on the same surface as point α, and is 1.0 mm away from the point of contact in the leftward direction. Further, the line which connects point α and point β indicates the angle of the slanted portion Qa-Qb. Referring to the projection, the normal line to the slanted portion Qa-Qb is definable as a line which is coincidental with the point of contact, and is perpendicular to the line α-β.

In this embodiment, the slanted portion Qa-Qb is straight. Therefore, the slanted portion Qa-Qb, is perpendicular to normal lines L1*a* and L1*b*.

Here, the image forming apparatus 30 is structured so that line L1*a*, which is coincident with force F1*a* which is applied to point Qa by the protrusive portion of the post-transfer guide 43, and line L1*b* which is coincident with force F1*b* which is applied to point Qb by the protrusive portion of the post-transfer guide 43, intersect with line L2. With the image forming apparatus being structured in this manner, lines L1 and L1 intersect with each other, between the intersection of the line L1*a* and line L2, and the intersection of line L1*b* and line L2, regardless of where on the slanted portion Qa-Qb the post-transfer guide 43 comes into contact with the entrance guide 40.

With the entrance guide 40 being configured so that it is provided with the slanted portion Qa-Qb which is shaped and positioned as described above, the relationship between the path which the protrusive portion of the post-transfer guide 43 takes as the door 44 is closed, and the force to which the entrance guide 40 is subjected, becomes as shown in part (b) of FIG. 9. That is, the image forming apparatus 30 is structured (entrance guide 40 is configured) so that the portion Qa-Qb of the entrance guide 40, which is the first portion of the entrance guide 40 with which the protrusive portion of the post-transfer guide 43 overlaps (meshes) as the door 44 is closed is slanted as described above. Therefore, the projection of the combination of the path of the protrusive portion of the post-transfer guide 43, entrance guide 40 having the slanted portion Qa-Qb, and frame 38, etc., upon a vertical plane which is perpendicular to the direction (widthwise direction) which is perpendicular to the direction a in which a sheet P is guided by the a sheet P of recording paper is guided by the sheet guiding surfaces of the two guides 40 and 43, becomes as shown in part (a) of FIG. 9. In this projection, Q stands for the point of the entrance guide 40, at which the post-transfer guide 43 begins to overlap with the entrance guide 40 as the door 44 is closed. That is, point Q is such a point of the entrance guide 40 that is within the recording paper conveyance range P, and the protrusive portion of the post-transfer guide 43 begins to overlap (meshes) with the entrance guide 40 as the post-transfer guide 43 is closed. This point Q is the very point of the entrance guide 40 which is pressed by a sheet P of recording paper in a case where the door 44 is closed with the presence of the sheet P between the entrance guide 40 and post-transfer guide 43, and therefore, the sheet P is pressed by the post-transfer guide 43. Normal line L1, shown in part (a) of FIG. 9 is such a line that is coincident with this point Q and perpendicular to the slanted portion Qa-Qb.

Further, referring to part (a) of FIG. 9, or the projection of the aforementioned combination, line L2 is such a line that extends leftward from the edge 47 of the frame 38, and is coincident with the anchoring portion 40*a*. It is coincident with the entrance guide supporting surface of the frame 38.

Here, "normal line L1 intersects with the entrance guide supporting surface of the frame 38*a*" means that normal line L1 intersects with the entrance guide supporting surface of the frame 38, between the edge 47 of the frame 38, which is on the sheet guiding surface side of the anchoring portion 40*a*, and the point 48 of the frame 38, which supports the entrance guide 40 by the door side end of the entrance guide 40. Thus, force F2 to which the anchoring portion 40 is subjected generates compressive stress in the anchoring portion 40*a*. That is, if the door 44 is closed while a sheet P of recording paper is between the entrance guide 40 and post-transfer guide 43, the slanted portion Qa-Qb of the entrance guide 40 catches force F1 from the sheet P. Thus, moment M generated in the entrance guide 40 is such that works in the direction indicated by an arrow mark M in part (a) of FIG. 9 to rotate the entrance guide 40 about the edge 47 of the frame 38. Therefore, force F2 to which the anchoring portion 40*a* is subjected generates compressive stress. Thus it is unlikely for the entrance guide 40 to be damaged.

By the way, should normal line L1 extends from the edge 47 of the frame 38 in the opposite direction from the door 44 (leftward in part (a) of FIG. 9), and therefore, does not intersect with the entrance guide supporting surface of the frame 38, such moment that works in the direction to rotate the entrance guide 40 about the edge 47 of the frame 38 in the opposite direction from the direction indicated by the arrow mark M in part (a) of FIG. 9 is generated in the entrance guide 40, subjecting therefore the anchoring portion 40*a* to tensional stress, which possibly leads to the damage to the anchoring portion 40*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2017-014079 filed on Jan. 30, 2017 and 2017-233339 filed on Dec. 5, 2017, which are hereby incorporated by reference herein in their entirety.

What is claimed is:

1. An image forming apparatus comprising:

a main assembly;

a transfer portion provided in said main assembly and configured to transfer a toner image onto a transfer nip;

a fixing portion provided in said main assembly and configured to fix, at a fixing nip, the toner image transferred by said transfer portion;

an opening provided on said main assembly;

an openable member movable between a closing position for closing said opening and an open position for opening said opening; and a first guiding member and a second guiding member cooperative with each other to provide a feeding surface for a recording material from the transfer nip toward said fixing nip, in a state that said openable member is in the closing position, wherein when said openable member is in the open position, said first guiding member is in said main assembly, wherein said second guiding member movable together with said openable member in interrelation with opening and closing operation of said openable member, wherein said first guiding member and said second guiding member form the feeding surface by a projection of said second guiding member being placed in a recess of said first guiding member with a closing operation of said openable member moving from the open position to the closing position, wherein when said openable member is in the closing position, the first guiding member is downstream of said second guiding member with respect to a feeding direction of the recording material, wherein when said openable member is in the closing position, said recess of said first guiding member is recessed toward a downstream side with respect to the feeding direction, and said projection of said second guiding member is projected toward the downstream side with respect to the feeding direction, wherein said image forming apparatus further comprises a metal plate extending in a lateral direction perpendicular to the feeding direction of the recording material and having a supporting surface supporting said first guiding member across the lateral direction, wherein said first guiding member is fixed to said supporting surface, wherein as seen in the lateral direction, said first guiding member has a convex curved surface portion at a position where said first guiding member first overlaps with said projection of said second guiding member in the closing operation of said openable member, wherein as (1) said projection of said second guiding member, (2) said first guiding member at a position having the curved surface portion in the lateral direction, and (3) said metal plate are seen in the lateral direction, said curved surface portion is formed such that a normal line L to an imaginary tangent line of said curved surface portion passing through a point Q crosses with said supporting surface of said metal plate, and wherein the point Q is a point on said curved surface portion which starts to overlap with said projection of said second guiding member in the closing operation of said openable member.

2. An apparatus according to claim 1, wherein said fixing nip is disposed above said transfer nip.

3. An apparatus according to claim 2, wherein said supporting surface of said metal plate is disposed above said curved surface portion.

4. An apparatus according to claim 1, wherein said fixing portion includes a first rotatable member and a second rotatable member constituting said fixing nip therebetween, and said metal plate is provided with a supporting portion rotatably supporting said first rotatable member at each of the opposite end portions with respect to the lateral direction of said metal plate.

5. An apparatus according to claim 1, wherein said first guiding member is provided with a plurality of such surface portions arranged in the lateral direction.

6. An apparatus according to claim 1, wherein said first guiding member includes a second recess, and said second recess is recessed toward a downstream side with respect to the feeding direction, when said openable member is in the closing position, and wherein said second guiding member includes a second projection movable toward said second recess with the closing operation of said openable member from the open position, and said second projection is projected toward the downstream side with respect to the feeding direction.

7. An apparatus according to claim 1, further comprising a hinge portion for fixing said openable member in the lateral direction, wherein said openable member is rotatable about said hinge portion between the closing position and the open position.

8. An apparatus according to claim 1, further comprising a slidable member configured to permit the sliding movement of said openable member in a direction perpendicular to the feeding surface, wherein said openable member is movable along said slidable member between the closing position and the open position.

9. An image forming apparatus comprising:

a main assembly;

a transfer portion provided in said main assembly and configured to transfer a toner image onto a transfer nip;

a fixing portion provided in said main assembly and configured to fix, at a fixing nip, the toner image transferred by said transfer portion;

an opening provided on said main assembly;

an openable member movable between a closing position for closing said opening and an open position for opening said opening; and a first guiding member and a second guiding member cooperative with each other to provide a feeding surface for a recording material from the transfer nip toward said fixing nip, in a state that said openable member is in the closing position, wherein when said openable member is in the open position, said first guiding member is in said main assembly, wherein said second guiding member movable together with said openable member in interrelation with opening and closing operation of said openable member, wherein the first guiding member and the second guiding member form the feeding surface by a projection of said second guiding member being placed in a recess of said first guiding member with a closing operation of said openable member moving from the open position to the closing position, wherein when said openable member is in the closing position, the first guiding member is downstream of said second guiding member with respect to a feeding direction of the recording material, wherein when said openable member is in the closing position, said recess of said first guiding member is recessed toward a downstream side with respect to the feeding direction, and said projection of said second guiding member is projected toward the downstream side with respect to the feeding direction, wherein said image forming apparatus further comprises a metal plate extending in a lateral direction perpendicular to the feeding direction of the recording material and having a supporting surface supporting said first guiding member across the lateral direction, wherein said first guiding member is fixed to said supporting surface, wherein as seen in the lateral direction, said first guiding member has an inclined portion extending so as to approach said opening as going from an upstream side toward a downstream side in the feeding direction, at a position where said first guiding member first overlaps with said projection of said second guiding member in the closing operation of said openable member, wherein as (1) said projection of said second guiding member, (2) said first guiding member at a position having said inclined portion in the lateral direction, and (3) said metal plate are seen in the lateral direction, said inclined portion is formed such that a normal line L to said inclined portion passing through a point Q crosses with said supporting surface of said metal plate, and wherein the point Q is a point on said inclined portion which starts to overlap with said projection of said second guiding member in the closing operation of the openable member.

10. An apparatus according to claim 9, wherein said fixing nip is disposed above said transfer nip.

11. An apparatus according to claim 9, wherein said supporting surface of said metal plate is disposed above said inclined portion.

12. An apparatus according to claim 9, wherein said fixing portion includes a first rotatable member and a second rotatable member constituting said fixing nip therebetween, said metal plate is provided with a supporting portion rotatably supporting said first rotatable member at each of the opposite end portions with respect to the lateral direction of said metal plate.

13. An apparatus according to claim 9, wherein said first guiding member is provided with a plurality of such inclined portions arranged in the lateral direction.

14. An apparatus according to claim 9, wherein said first guiding member includes a second recess, and said second recess is recessed toward a downstream side with respect to the feeding direction, when said openable member is in the closing position, and wherein said second guiding member includes a second projection movable toward said second recess with the closing operation of said openable member from the open position, and said second projection is projected toward the downstream side with respect to the feeding direction.

15. An apparatus according to claim 9, further comprising a hinge portion for fixing said openable member in the lateral direction, wherein said openable member is rotatable about said hinge portion between the closing position and the open position.

16. An apparatus according to claim 9, further comprising a slidable member configured to permit the sliding movement of said openable member in a direction perpendicular to the feeding surface, wherein said openable member is movable along said slidable member between the closing position and the open position.

17. An image forming apparatus comprising:

a main assembly;

an image forming portion provided in said main assembly and configured to form a toner image on a recording material;

a fixing portion provided in said main assembly and configured to fix, at a fixing nip, the toner image formed by said image forming portion;

an opening provided on said main assembly;

an openable member movable between a closing position for closing said opening and an open position for opening said opening; and a first guiding member and a second guiding member cooperative with each other to provide a feeding surface for a recording material from a transfer nip toward said fixing nip, in a state that said openable member is in the closing position, wherein when said openable member is in the open position, said first guiding member is in said main assembly, wherein said second guiding member movable together with said openable member in interrelation with opening and closing operation of said openable member, wherein said first guiding member and said second guiding member form the feeding surface by such a movement of said second guiding member that a projection of said first guiding member being placed in a recess of said second guiding member with a closing operation of said openable member moving from the open position to the closing position, wherein when said openable member is in the closing position, the first guiding member is downstream of said second guiding member with respect to a feeding direction of the recording material, wherein when said openable member is in the closing position, said projection of said first guiding member is projected toward an upstream side with respect to the feeding direction, and said recess of said second guiding member is recessed toward the upstream side with respect to the feeding direction, wherein said image forming apparatus further comprises a metal plate extending in a lateral direction perpendicular the feeding direction of the recording material and having a supporting surface supporting said first guiding member across the lateral direction, wherein said first guiding member is fixed to said supporting surface, wherein as seen in the lateral direction, said first guiding member has a convex curved surface portion at a position where said first guiding member first overlaps with said second guiding member in the closing operation of said openable member, wherein as (1) said second guiding member, (2) said first guiding member at a position having said curved surface portion in the lateral direction, and (3) said metal plate are seen in the lateral direction, said curved surface portion is formed such that a normal line L to an imaginary tangent line of said curved surface portion passing through a point Q crosses with said supporting surface of said metal plate, and wherein the point Q is a point on said curved surface portion which starts to overlap with said second guiding member in the closing operation of said openable member.

18. An image forming apparatus comprising:

a main assembly;

an image forming portion provided in said main assembly and configured to form a toner image on a recording material;

a fixing portion provided in said main assembly and configured to fix, at a fixing nip, the toner image formed by said image forming portion;

an opening provided on said main assembly;

an openable member movable between a closing position for closing said opening and an open position for opening said opening; and a first guiding member and a second guiding member cooperative with each other to provide a feeding surface for a recording material from a transfer nip toward said fixing nip, in a state that said openable member is in the closing position, wherein when said openable member is in the open position, said first guiding member is in said main assembly, wherein said second guiding member movable together with said openable member in interrelation with opening and closing operation of said openable member, wherein said first guiding member and said second guiding member form the feeding surface by such a movement of said second guiding member that a projection of said first guiding member being placed in a recess of said second guiding member with a closing operation of said openable member moving from the open position to the closing position, wherein when said openable member is in the closing position, the first guiding member is downstream of said second guiding member with respect to a feeding direction of the recording material, wherein when said openable member is in the closing position, said projection of said first guiding member is projected toward an upstream side with respect to the feeding direction, and said recess of said second guiding member is recessed toward the upstream side with respect to the feeding direction, wherein said image forming apparatus further comprises a metal plate extending in a lateral direction perpendicular to the feeding direction of the recording and having a supporting surface supporting said first guiding member across the lateral direction, wherein said first guiding member is fixed to said supporting surface, wherein as seen in the lateral direction, said first guiding member has an inclined portion extending so as to approach said opening as going from a upstream side toward a downstream side in the feeding direction, at a position where said first guiding member first overlaps with said second guiding member in the closing operation of said openable member, wherein as (1) said second guiding member, (2) said first guiding member at a position having said inclined portion in the lateral direction, and (3) said metal plate are seen in the lateral direction, said inclined portion is formed such that a normal line L to said inclined portion passing through a point Q crosses with said supporting surface of said metal plate, and wherein the point Q is a point on said inclined portion which starts to overlap with said second guiding member in the closing operation of the openable member.

19. An image forming apparatus comprising:

a main assembly;

a transfer portion provided in said main assembly and configured to transfer a toner image onto a transfer nip;

a fixing portion provided in said main assembly and configured to fix, at a fixing nip, the toner image transferred by said transfer portion;

an opening provided on said main assembly;

an openable member movable between a closing position for closing said opening and an open position for opening said opening; and a first guiding member and a second guiding member cooperative with each other to provide a feeding surface for a recording material from the transfer nip toward said fixing nip, in a state that said openable member is in the closing position, wherein when said openable member is in the open position, said first guiding member is in said main assembly, wherein said second guiding member movable together with said openable member in interrelation with opening and closing operation of said openable member, wherein said first guiding member and said second guiding member form the feeding surface by a projection of said second guiding member being placed in a recess of said first guiding member with a closing operation of said openable member moving from the open position to the closing position, wherein when said openable member is in the closing position, the first guiding member is downstream of said second guiding member with respect to a feeding direction of the recording material, wherein when said openable member is in the closing position, said recess of said first guiding member is recessed toward a downstream side with respect to the feeding direction, and said projection of said second guiding member is projected toward the downstream side with respect to the feeding direction, wherein said image forming apparatus further comprises a metal plate extending in a lateral direction perpendicular to the feeding direction of the recording material and having a supporting surface supporting said first guiding member across the lateral direction, wherein said first guiding member is fixed to said supporting surface, and wherein as seen in the lateral direction, said first guiding member has a convex curved surface portion at a position where said first guiding member first overlaps with said projection of said second guiding member in the closing operation of said openable member.

20. An image forming apparatus comprising:

a main assembly;

a transfer portion provided in said main assembly and configured to transfer a toner image onto a transfer nip;

a fixing portion provided in said main assembly and configured to fix, at a fixing nip, the toner image transferred by said transfer portion;

an opening provided on said main assembly;

an openable member movable between a closing position for closing said opening and an open position for opening said opening; and a first guiding member and a second guiding member cooperative with each other to provide a feeding surface for a recording material from the transfer nip toward said fixing nip, in a state that said openable member is in the closing position, wherein when said openable member is in the open position, said first guiding member is in said main assembly, wherein said second guiding member movable together with said openable member in interrelation with opening and closing operation of said openable member, wherein the first guiding member and the second guiding member form the feeding surface by a projection of said second guiding member being placed in a recess of said first guiding member with a closing operation of said openable member moving from the open position to the closing position, wherein when said openable member is in the closing position, the first guiding member is downstream of said second guiding member with respect to a feeding direction of the recording material, wherein when said openable member is in the closing position, said recess of said first guiding member is recessed toward a downstream side with respect to the feeding direction, and said projection of said second guiding member is projected toward the downstream side with respect to the feeding direction, and wherein said image forming apparatus further comprises a metal plate extending in a lateral direction perpendicular to the feeding direction of the recording material and having a supporting surface supporting said first guiding member across the lateral direction, wherein said first guiding member is fixed to said supporting surface, and wherein as seen in the lateral direction, said first guiding member has an inclined portion extending so as to approach said opening as going from a upstream side toward a downstream side in the feeding direction, at a position where said first guiding member first overlaps with said projection of said second guiding member in the closing operation of said openable member.

* * * * *